US007924226B2

(12) United States Patent
Soler Castany et al.

(10) Patent No.: US 7,924,226 B2
(45) Date of Patent: Apr. 12, 2011

(54) TUNABLE ANTENNA

(75) Inventors: Jordi Soler Castany, Mataró (ES); Carles Puente Baliarda, Barcelona (ES); José Mumbru Forn, Barcelona (ES)

(73) Assignee: Fractus, S.A., Barcelona (ES)

( * ) Notice: Subject to any disclaimer, the term of this patent is extended or adjusted under 35 U.S.C. 154(b) by 871 days.

(21) Appl. No.: 11/576,015

(22) PCT Filed: Sep. 1, 2005

(86) PCT No.: PCT/EP2005/054297

§ 371 (c)(1),
(2), (4) Date: Mar. 26, 2007

(87) PCT Pub. No.: WO2006/034940

PCT Pub. Date: Apr. 6, 2006

(65) Prior Publication Data

US 2008/0062049 A1 Mar. 13, 2008

Related U.S. Application Data

(60) Provisional application No. 60/613,394, filed on Sep. 27, 2004, provisional application No. 60/640,380, filed on Dec. 30, 2004.

(51) Int. Cl.
*H01Q 1/24* (2006.01)
*H01Q 1/38* (2006.01)

(52) U.S. Cl. ..... 343/700 MS; 343/702; 343/895

(58) Field of Classification Search ..... 343/700 MS, 343/702, 895

See application file for complete search history.

(56) References Cited

U.S. PATENT DOCUMENTS

| | | | |
|---|---|---|---|
| 3,680,135 | A | 7/1972 | Boyer |
| 3,713,162 | A | 1/1973 | Munson et al. |
| 4,243,990 | A | 1/1981 | Nemit |
| 4,381,566 | A | 4/1983 | Kane |
| 4,626,862 | A | 12/1986 | Ma |
| 4,843,468 | A | 6/1989 | Drewery |
| 5,363,114 | A | 11/1994 | Shoemaker |

(Continued)

FOREIGN PATENT DOCUMENTS

EP 0 655 797 A1 5/1995

(Continued)

OTHER PUBLICATIONS

Anagnostou, D., Smart reconfigurable antennas for satellite applications, IEEE: Core Technologies for space system configurations, Nov. 2001.

(Continued)

*Primary Examiner* — Tan Ho
(74) *Attorney, Agent, or Firm* — Kenyon & Kenyon LLP

(57) ABSTRACT

The invention refers to an antenna comprising: a conducting trace (15, 20), said conducting trace (15, 20) defining a curve (1, 4, 5, 6, 6', 6", 8), said curve (1, 4, 5, 6, 6', 6", 8) including two or more feeding points (16*a*, 16*b*, 16*c*, 17, 18, 19), a portion of said curve (1, 4, 5, 6, 6', 6", 8) being shaped according a geometry selected from a group of geometries including a space-filling curve, a grid-dimension curve, a box-counting curve and a contour curve or the curve (1, 4, 5, 6, 6', 6", 8) or a portion of said curve having a shape of a multilevel structure. Further the invention refers to a related SMD component, an IC-package, a wireless device and a method for contacting an antenna.

104 Claims, 31 Drawing Sheets

U.S. PATENT DOCUMENTS

| | | | | |
|---|---|---|---|---|
| 5,621,199 | A | 4/1997 | Calari | |
| 5,621,913 | A | 4/1997 | Tuttle | |
| 5,710,458 | A | 1/1998 | Iwasaki | |
| 5,778,308 | A | 7/1998 | Sroka et al. | |
| 6,011,518 | A | 1/2000 | Yamagishi et al. | |
| 6,087,990 | A | 7/2000 | Thill et al. | |
| 6,107,920 | A | 8/2000 | Eberhardt | |
| 6,147,655 | A | 11/2000 | Roesner | |
| 6,181,281 | B1 | 1/2001 | Desclos | |
| 6,198,438 | B1 | 3/2001 | Herd et al. | |
| 6,236,366 | B1 | 5/2001 | Yamamoto | |
| 6,239,752 | B1 | 5/2001 | Blanchard | |
| 6,263,193 | B1 | 7/2001 | Iseki | |
| 6,285,342 | B1 | 9/2001 | Brady | |
| 6,307,519 | B1 | 10/2001 | Livingston | |
| 6,317,092 | B1 | 11/2001 | Schweinitz | |
| 6,320,543 | B1 | 11/2001 | Ohata | |
| 6,333,719 | B1 | 12/2001 | Varadan et al. | |
| 6,362,784 | B1 * | 3/2002 | Kane et al. | 343/700 MS |
| 6,373,447 | B1 | 4/2002 | Rostoker | |
| 6,377,217 | B1 | 4/2002 | Zhu | |
| 6,388,631 | B1 | 5/2002 | Livingston et al. | |
| 6,421,013 | B1 | 7/2002 | Chung | |
| 6,424,315 | B1 | 7/2002 | Glenn | |
| 6,459,413 | B1 | 10/2002 | Tseng et al. | |
| 6,504,507 | B2 | 1/2003 | Geeraert | |
| 6,611,237 | B2 | 8/2003 | Smith | |
| 6,639,555 | B1 * | 10/2003 | Kane et al. | 343/700 MS |
| 6,646,609 | B2 | 11/2003 | Yuasa | |
| 6,650,295 | B2 | 11/2003 | Ollikainen | |
| 6,662,028 | B1 | 12/2003 | Hayes | |
| 6,670,921 | B2 | 12/2003 | Slevenpiper | |
| 6,693,594 | B2 | 2/2004 | Pankinaho | |
| 6,744,411 | B1 | 6/2004 | Osterhues et al. | |
| 6,756,939 | B2 | 6/2004 | Chen | |
| 6,762,719 | B2 | 7/2004 | Subetic | |
| 6,765,536 | B2 | 7/2004 | Phillips et al. | |
| 6,870,507 | B2 * | 3/2005 | Anguera Pros et al. | 343/700 MS |
| 7,026,997 | B2 * | 4/2006 | Rahola | 343/700 MS |
| 7,202,835 | B2 | 4/2007 | Chiang et al. | |
| 7,310,065 | B2 * | 12/2007 | Anguera Pros et al. | 343/700 MS |
| 7,417,588 | B2 * | 8/2008 | Castany et al. | 343/700 MS |
| 7,471,246 | B2 * | 12/2008 | Soler Castany et al. | 343/700 MS |
| 7,511,675 | B2 * | 3/2009 | Puente-Baliarda et al. | 343/713 |
| 7,675,470 | B2 * | 3/2010 | Sanz et al. | 343/702 |
| 2002/0005433 | A1 | 1/2002 | Nochi | |
| 2002/0058539 | A1 | 5/2002 | Underbrink | |
| 2003/0122721 | A1 | 7/2003 | Sievenpiper | |
| 2003/0201942 | A1 | 10/2003 | Poilasne | |
| 2004/0014428 | A1 | 1/2004 | Franca-Neto | |
| 2004/0119644 | A1 | 6/2004 | Puente Baliarda | |
| 2004/0125027 | A1 | 7/2004 | Rubinshteyn et al. | |
| 2004/0145521 | A1 | 7/2004 | Hebron | |
| 2004/0227678 | A1 | 11/2004 | Sievenpiper | |
| 2007/0040751 | A1 | 2/2007 | Boyle | |

FOREIGN PATENT DOCUMENTS

| | | | |
|---|---|---|---|
| EP | 0902472 | A2 | 3/1999 |
| EP | 0969375 | | 1/2000 |
| EP | 0978729 | A2 | 2/2000 |
| EP | 1011167 | A1 | 6/2000 |
| EP | 1085597 | A2 | 3/2001 |
| EP | 1126522 | A1 | 8/2001 |
| EP | 1130677 | A2 | 9/2001 |
| EP | 1137100 | A2 | 9/2001 |
| EP | 1307078 | A2 | 2/2002 |
| EP | 1198027 | A1 | 4/2002 |
| EP | 1248317 | A1 | 10/2002 |
| EP | 1326302 | A3 | 11/2003 |
| EP | 1396906 | A1 | 3/2004 |
| EP | 00909089.5 | B1 | 8/2005 |
| EP | 1610411 | A1 | 12/2005 |
| ES | 2112163 | | 3/1998 |
| FR | 2849288 | | 6/2004 |
| JP | 11220319 | | 8/1999 |
| JP | 2001332924 | | 11/2001 |
| JP | 2002190706 | | 7/2002 |
| JP | 2006174449 | | 6/2006 |
| WO | 9706578 | | 2/1997 |
| WO | 9927608 | | 6/1999 |
| WO | 9934480 | A1 | 7/1999 |
| WO | 0105048 | A1 | 1/2001 |
| WO | 0122528 | A1 | 3/2001 |
| WO | 0154225 | A1 | 7/2001 |
| WO | 0229929 | A2 | 4/2002 |
| WO | 02/052679 | A1 | 7/2002 |
| WO | 02060004 | A2 | 8/2002 |
| WO | 02/095869 | A1 | 11/2002 |
| WO | 02089246 | A2 | 11/2002 |
| WO | 02096166 | A1 | 11/2002 |
| WO | 03050913 | A1 | 6/2003 |
| WO | 03/065499 | A1 | 8/2003 |
| WO | 03/096475 | A1 | 11/2003 |
| WO | 03096474 | A1 | 11/2003 |
| WO | 2004025778 | A1 | 3/2004 |
| WO | 2004/038852 | A2 | 5/2004 |
| WO | 2004042868 | A1 | 5/2004 |
| WO | 2004097976 | A2 | 11/2004 |

OTHER PUBLICATIONS

Anagnostou, D., Fractal antenna with RF MEMS switches for multiple frequency applications, IEEE, Antennas and Propagation Society International Symposium, Jun. 2002.

F. Yang et al. Patch antenna with switchable slots (PASS): reconfigure design for wireless communications, IEEE Antennas and Propagation Society International Symposium, Jun. 2002.

Bhavsar, Samir A.: Letter: *Fractus* v. *Samsung* et al., Case No. 6:09-cv-00203-LED: Disclosure of Material Information to the USPTO; Oct. 28, 2009.

Wille, David G.: HTC's First Amended Answer and Counterclaim; Oct. 2, 2009.

Wimer, Michael C.; USPTO Office Actions for U.S. Appl. No. 10/422,578; Oct. 4, 2004, Apr. 7, 2005, Aug. 24, 2005, Jan. 26, 2006, Mar. 12, 2007, Aug. 23, 2007 and Mar. 26, 2008.

D.A. Russell, J.D. Hanson, E. Ott, "Dimension and Strange Attractors", Phys. Rev. Lett. 45 (1980) 1175-1178.

Paul So., Ernest Barreto, and Brian R. Hunt, "Box-counting dimension without boxes: Computing D0 from average expansion rates", Physical Review E (Statistical Physics, Plasmas, Fluids, and Related Interdisciplinary Topics)—Jul. 1999—vol. 60, Issue 1, pp. 378-385.

http://www.redbrick.dcu.ie/~bolsh/thesis/node16.html.

http://www.redbrick.dcu.ie/~bolsh/thesis/node22.html.

http://www.sewanee.edu/physics/PHYSICS123/BOX%20COUNTING%20DIMENSION.html.

Heinz-Otto Peitgen, et al, "Chaos and Fractals—New Frontiers of Science" (1992), pp. 212-216, 387-388.

Paul S. Addison, "Fractals and Chaos—An illustrated Course" (Institute of Physics Publishing, Bristol and Philadelphia; IOP Publishing 1997), pp. 30, 31 & 33.

Kenneth Falconer, "Fractal Geometry—Mathematical Foundations and Applications" (2nd edition) (John Wiley & Sons. Ltd., 2003) (the first edition is from 1990).

Yuan Y. Tang. et al., "The application of Fractal Analysis to Feature Extraction" (1999 IEEE). pp. 875-879.

Vincent Ng. et al., "Diagnosis of Melanoma with Fractal Dimensions" (IEEE TENCON'93 / Beijing), pp. 514-517.

S. Kobayashi et al., "Estimation of 3d Fractal Dimension of Real Electrical Tree Patterns" (IEEE 1994; Proceedings of the 4th International Conference on Properties and Applications of Dielectric Materials, Jul. 3-8, 1994 Brisbane, Australia), pp. 359-362.

Jie Feng et al., "Fractional Box-Counting Approach to Fractal Dimension Estimation", (IEEE 1996; Proceedings of ICPR'96), pp. 854-858.

S. Rouvier, et al., "Fractal Analysis of Bidimensional Profiles and Application to Electromagnetic Scattering from Soils" (1996 IEEE), pp. 2167-2169.

Nirupam Sarkar, et al., "An Efficient Differential Box-Counting Approach to Compute Fractal Dimension of Image" (IEEE Transactions on Systems, Man, and Cybernetics, vol. 24, No. 1, Jan. 1994), pp. 115-120.
Susan S. Chen, et al., "On the Calculation of Fractal Features from Images" (IEEE Transactions on Pattern Analysis and Machine Intelligence, vol. 15, No. 10, Oct. 1993), pp. 1087-1090.
Alan I. Penn, et al., "Fractal Dimension of Low-Resolution Medical Images" (18th Annual International Conference of the IEEE Engineering in Medicine and Biology Society, Amsterdam 1996; 4.5.3: Image Pattern Analysis I), pp. 1163-1165.
Fabrizio Berizzi, et al., "Fractal Analysis of the Signal Scattered from the Sea Surface" (IEEE Transactions on Antennas and Propagation, vol. 47, No. 2, Feb. 1999), pp. 324-338.
Hendrik F. V Boshoff, "A Fast Box Counting Algorithm for Determining the Fractal Dimension of Sampled Continuous Functions" (1992 IEEE), pp. 43-48.
Aug. 14, 2003 Reply to Examination Report for EP1258054 (00909089.5).
Oct. 28, 2004 Summons for EP1258054 (00909089.5).
Dec. 15, 2004 Letter Dealing with Oral Proceedings for EP1258054 (00909089.5).
Jan. 2005 Minutes from Oral Proceedings for EP1258054 (00909089.5).
International Preliminary Examination Report and International Search Report of Aug. 29, 2002 for PCT/EP00/00411 published as WO 01/54225 A1.
EPO Office Action for EP1258054 (00909089.5) dated Feb 7, 2003.
Hansen, R. C.: "Fundamental Limitations in Antennas"; Proceedings of the IEEE, IEEE. New York, US; Feb. 1981; ISSN 0018-9219, vol. 2, NR. 69, pp. 170-182.
Ramesh Garg et al., "Microstrip Antenna Design Handbook" (2001, Artech House, Inc.), selected pages.
Richard C. Johnson (Editor), "Antenna Engineering Handbook" (McGraw Hill Inc.), Chapter "Microstrip Antennas" by Robert E. Munson, selected pages.
Constantine A. Balanis, "Antenna Theory" (1982, John Wiley & Sons, Inc.),selected pages.
Keith R. Carver et al., "Microstrip Antenna Technology" (IEEE Transactions on Antennas and Propagation, vol. AP-29, No. 1, Jan. 1981), pp. 2-23.
David M. Pozar et al., "Microstrip Antennas—The Analysis and Design of Microstrip Antennas and Arrays" (1995, Institute of Electrical and Electronic Engineers, Inc.), p. ix and 3.
John D. Kraus, "Antennas" (1988, McGraw-Hill, Inc.), preface and list of contents.
Aberle, James T., et al., "Reconfigurable Antennas for Portable Wireless Devices", IEEE Antennas and Propagation Magazine, Dec. 2003, vol. 45, No. 6, pp. 148-154.
Chu, Physical limitations of omni-directional antennas, Journal of applied physics, 1945, vol. 10.
Wheeler, Fundamental limitations of small antennas, Proceedings of the IRE, Dec. 1974.
Harris et al., Handset industry debates Bluetooth options , Wireless Europe, Nov. 2006.
Judd, Estimating dimensions with confidence, International journal of Bifurcation and Chaos, Feb. 1991.
Zhang, Integration of a planar inverted F antenna on a cavity-down ceramic ball array package, IEEE, 2002.
Singh et al., Small h-shaped antennas for MMIC applications, IEEE Transactions on Antennas and Propagation, Jul. 2000.
Matsushima et al. Electromagnetically dielectric chip antenna, IEEE Transactions on antennas and propagation, Jun. 1998.
Lim, RF-System-on-package (SOP) for wireless communications, IEEE Microwave Magazine, Mar. 2002.
Bluetooth radio, www.palowireless.com, Agoust 2001.
Douglas, RF System in package: considerations, technologies and solutions, IEEE Times, 2003.
RF/Wireless design services, Amkor Technology, Jun. 2003.
Sherwani, Introduction to multichip modules, A Wiley-Interscience Publication, 1995.
Halbo, Electronic components, packaging and production, University of Oslo, 1995.
Karmakar, Tunable PIFA using low cost band switch diodes, IEEE Antennas and Propagation Society International Symposium, 2002.
Kivekas, Frequency-tunable internal antenna for mobiles phones, 12th International symposium on antennas (JINA 2002) Nice, France, 2002.
Dong et al., Dual-frequency planar inverted-F antenna, IEEE Transactions on Antennas and Propagation, 1997, vol. 45, No. 10.
Hansen, Fundamental limitations in antennas, IEEE, 1981.
Griffin, et al. Electromagnetic design aspects of packages for monolithic microwave integrated circuit-based arrays with integrated antenna elements. IEEE Transactions on Antennas and Propagation, 1995, vol. 43, No. 9.
Tanidokoro, I-wavelength loop dielectric chip antennas, IEEE Transactions on antennas and propagation, 1998.
Papapolymerou, Micromachined patch antennas, IEEE Transactions on Antennas and Propagation, 1998, vol. 46, No. 2.
Kim, Integrated dipole antennas on silicon substrates for intra-chip communicatioN, IEEE Transactions on Antennas and Propagation, 1999.
Kivekaes, Design of high-efficiency antennas for mobile communications devices, Helsinki University of Technology, Aug. 2005.
Ollikainen, Design and implementation techniques of wideband mobile communications antennas, Helsinki University of Technology, Nov. 2004.
Ollikainen, Low-loss tuning circuits for frequency-tunable small resonant antennas, Antennas Online, Jan. 2005.
Villanen et al, Design and characterization of antenna for mobile terminals, Helsinki University of Technology, Aug. 2004.
Setter, N. et al, Polar ceramics in RF-MEMS and microwave reconfigurable electronics—A brief review on recent issues, Journal of Electroceramics, Mar. 4, 2004.
Petko, J.S. et al, Reconfigurable miniature three dimensional fractal tree antenna, IEEE Antennas and Propagation Society International Symposium, Jun. 2003.
Gilbert, R. ; Pirrung, A. ; Kopf, D. et al. Structurally-integrated optically-reconfigurable antenna array. Antenna Applications Symposium, 1995.
Warnagiris, T. ; Minardo, T. Performance of a meandered line as an electrically small transmitting antenna. IEEE Transactions on Antennas and Propagation. vol. 46. No. 12, 1998, pp. 1797-1801.

* cited by examiner

FRONT VIEW

Detail A

TUNABLE ANTENNA

CROSS REFERENCE TO RELATED APPLICATIONS

This application is related to application number U.S. 60/613,394 filed on Sep. 27, 2004, in the U.S. and to application number U.S. 60/640,380 filed on Dec. 30, 2004 in the U.S. and claims priority to those applications, which are incorporated herein by reference.

This is a 371 national phase application of PCT/EP2005/054297, filed Sep. 1, 2005.

The present invention relates to a tunable antenna.

Tunable antennae are desirable in order to have multiple operating frequencies, impedances, bandwidths or efficiencies available with one antenna only or to be able to compensate undesired frequency shifts, impedance shifts, bandwidth shifts or efficiency shifts or combinations of those effects.

One of the challenges of small SMD antenna devices is to provide a standard, low cost component that can be used throughout a wide range of products with many different form factors. Usually, the resonant frequency of the antenna changes with the interaction of the surrounding components (e.g., the ground of the PCB, the plastic covers, etc.)

This frequency change may render the device useless, since in communication systems the operating frequencies or at least ranges thereof are well defined and have to be maintained. It is therefore desirable to be able to compensate for such changes of the resonant frequency in order to maintain a particular resonant frequency or frequency band. In particular for the mass production of wireless devices, it is desirable to have one antenna type, that may be used for different wireless devices or may be used in one wireless device for different operating frequencies.

There is a trend in the semiconductor industry towards the so-called System on Chip (SoC) and System in Package (SiP) concepts. The full integration of systems or subsystems into a single chip (Fully Wireless System in Package/on Chip, FWSiP/FWSoC) provides many advantages in terms of cost, size, weight, power consumption, performance, modularity and product design complexity. Several electronic devices for consumer applications, such as handsets, wireless devices (headsets, dongles, computer interfaces, computer mouse, keyboards, remote controls), personal digital assistants (PDAs) or personal computers (PCs) include more and more of these SiP/SoC components. The introduction of wireless capabilities in many other devices such as digital cameras, MP3 players, portable DVD/CD players, smoke detectors, switches, sensors (such as for instance motion, pressure, temperature, medical sensors and meters) and alarms will be made easier through such compact, integrated SiP/SoC devices.

It is therefore an object of the present invention to provide an improved antenna, an improved SMD component, an improved IC-package, an improved wireless device and an improved method of contacting an antenna.

This problem is solved for instance by the antenna of claim 1, the SMD component of claim 21 or 22, the IC package of claim 42, the wireless device of claim 62, the wireless device of claim 74, the wireless device of claim 86 or the method of claim 100. Preferred embodiments are disclosed in the dependent claims.

The antenna comprises a conducting trace, which may be contacted by two or more feeding points. Depending on the contacted feeding point or the combination of contacted feeding points, the resonant frequency, the impedance, the bandwidth or the efficiency of the antenna is different. Thereby it is possible to tune the antenna by the way the antenna is contacted.

In accordance with the teachings described herein, systems and methods are provided for an antenna having multiple feed points that may be used to adjust characteristics of the antenna such as resonant frequency, impedance, bandwidth, and efficiency. The antenna may, for example, be integrated in a surface mount component (SMD/SMT) to be mounted on a ground plane or (printed) circuit board (PCB). (The terms SMD component (surface mount device component) and SMT component (surface mount technology component) both refer to the same and are used equally to describe components which may be surface mount). The antenna may, for example, be printed directly on the PCB of an electronic circuit or wireless device. In addition, the antenna may, for example, be embedded in an integrated circuit package or module that includes other parts of a wireless or radio frequency system.

The antenna described herein may, for example, be used in a wide range of wireless products with many different form factors, such as cellular and handheld telephones (handsets), wireless multimedia terminals, PDAs, portable music players (e.g., MP3 players, CD players, portable analog and digital radios), digital cameras, USB dongles, wireless headsets and earphones, hands-free kits, electronic games, remote controls, light switches, alarms and sensors for home-RF and automotive applications. In addition, the antenna described herein may be used for wireless connectivity applications, including systems for communicating in various frequency bands, such as 2.4 GHz, Bluetooth, 2.4 GHz, IEEE 802.11b/g, 5 GHz, IEEE 802.11a, ZigBee, GPS, Galileo, GSM-900, DCS-1800, UMTS, CDMA, DAB, or other bands. The antenna described herein may, for example, also be used in several geographical domains where the spectrum allocation for radio services are different (e.g., the antenna may cover the 860 MHz ZigBee European band or the 915 MHz ZigBee US band.) It should be understood, however, that other applications are also possible. The shape of the conducting trace is predetermined by the antenna structure. Thereby the antenna properties are mainly predetermined by the given shape.

In many cases, the ultimate component to achieve the true integration of a FWSiP/FWSoC component is the antenna. The concept of integrating a miniature antenna into a package or module is especially attractive due to the tremendous growth and success of cellular and wireless systems. In particular, there is a new generation of short/medium range wireless connectivity applications such as Bluetooth™, Hyperlan, IEEE802.11 (WiFi), ultra wide band (UWB), Wimax and ZigBee systems where the progressive system integration into a single, compact product is becoming a key success factor.

One of the challenges of FWSiP/FWSoC devices is to provide a standard solution that can be used throughout a wide range of products with many different form factors. Usually, the resonant frequency of the antenna changes with the interaction of the surrounding components (mainly the size and shape of the ground plane of the PCB, position on the PCB on which it is mounted, the ground plane clearance, the presence of plastic covers, and so on). The technology described herein presents ways to overcome this problem by providing an IC package with an integrated antenna that can be configured to perform well in many different environments.

The technology described herein provides a miniature antenna integrated into an IC package or module. The IC package or module may, for example, be used as a connectivity solution in several wireless connectivity applications. For instance, the IC package or module described herein may include an antenna that operates in the following systems and frequency bands: 2.4 GHz—Bluetooth™, 2.4 GHz—IEEE 802.11b/g, 5 GHz—IEEE 802.11a, ZigBee, GPS, Galileo, GSM-900, DCS-1800, UMTS, CDMA, PCS1900, KPCS, WCDMA and DAB bands.

In addition, the configurability and/or tunability of the antenna integrated in the IC package may provide a single FWSiP/FWSoC solution that can be used in several geographical domains where the spectrum allocation for radio services are different. For instance, in one example the antenna can be tuned to cover the European band or US band of ZigBee (860 MHz and 915 MHz respectively), while in another example the same AiP (Antenna in Package) module can cover either the 2.4-2.483 GHz band or the 2.471-2.497 GHz band, corresponding to the US/European and Japanese standards of Bluetooth™ respectively.

In a preferred embodiment at the feeding point, means for electrically contacting the conducting trace are provided in order to facilitate the antenna mounting. The means for electrically contacting the conducting trace may be anything that distinguishes from the trace itself and allows for contacting the trace.

In a preferred embodiment the trace may be comprised of a rigid piece and/or may be held by a rigid backing. Different materials for the rigid piece or rigid, stiff or solid backing are possible, as disclosed in the description or the claims. The rigid piece may be a stamped or punched piece of metal that maintains its shape already only due its own stiffness.

In a preferred embodiment, the antenna is provided directly on a circuit board, e.g. by printing or by etching from a conductive layer, or by a thick film process, or a thin film process. The advantage of the antenna being provided directly on the circuit board is the improved fabrication process, since the antenna may be prepared together with other circuitry.

The antenna may have one, two, three or more radiating arms. While only one radiating arm has the advantage of the possibility to use the given space with one single lengthy trace, the provision of more radiating arms offers the advantage to have more freedom in the antenna design, since the antenna geometry can be used to define, e.g., the resonant frequency, impedance, bandwidth and efficiency.

The trace may be continuous or discontinuous. Should the trace be discontinuous, the parts of the trace at the discontinuity may be not directly coupled by contact, but electromagnetically coupled by electromagnetic fields. The option of a discontinuous antenna allows for further design parameters in antenna design.

The conducting trace may comprise several separated parts or blocks. Each of those parts or blocks may have at least one, two, three or more feeding points. This allows for a very flexible system, where antenna properties can be varied to a great extend. It is for example possible to only contact one or the other of said separated parts. Since each separated part may have different antenna properties this allows for an appropriate selection. Further it is possible to connect two, three or more separated parts together allowing for all kind of antenna configurations such as a monopole, a dipole, an antenna with multiple radiation arms, etc. The length of the different arms can be selected by the choice of one or the other separated part or by connecting two or more parts together. Some or all of the separated parts may be different. The different parts may be connected together by e.g. an external by-pass or an external circuit, a switch, a switchable transistor or resistor, a filter, a matching network, an inductive, capacitive or generally passive network or by an active network or anything suitable. This allows for further antenna design options. For the connection of two separated parts also more than one of the above mentioned ways may be available. Two parts may e.g. be connected by a switch or by a network depending on the users selection.

A further possibility for designing the antenna properties is to couple the trace to another antenna structure, such as e.g. a polygonal or multilevel surface. Such surfaces may be coupled by direct contact or by electromagnetic coupling. This other antenna structure is preferably conducting or dielectric.

In a preferred embodiment the trace, or at least part of the trace, is covered by an insulator. This facilitates handling and mounting of the antenna, protects the conducting trace and further prevents the conducting trace from changing its electric properties due to protection of the conducting trace from environmental influences such as humidity, or aggressive gases. Further, by covering the trace, or at least part of the trace with an insulator, the surrounding of the antenna very close to the antenna is electromagnetically provided in a well-defined way, such that the electromagnetic properties of the antenna do not change so easily by providing the antenna in different environments. Further the insulator defines openings to the feeding points which may be e.g. configured for soldering in order to define the soldered areas. Different materials as disclosed in the description or in the claims may be used for the insulator.

At the feeding points the trace is preferably uncovered. This allows for easy contacting of the trace at the feeding points. The feeding points may alternatively also be covered by an easily removable cover such as a foil or the like. This cover may also cover part of the insulator. A single cover may be used for different feeding points. The cover offers the advantage of protecting the feeding points up to, e.g., mounting the antenna.

The antenna may be provided together with an integrated circuit. This integrated circuit may be adapted to feed the antenna and/or to contact the antenna or to connect separated parts of the antenna. The integrated circuit may provide other functions such as data processing for data transmission or data reception according to one, two or more specific data communication system.

The antenna may be provided in the conductive layer of a circuit board, wherein this conductive layer is also used to provide the contacts to the integrated circuit. The antenna may also be provided as an item which is mounted to a circuit board on which also the integrated circuit is mounted. The antenna and the integrated circuit may be provided on the same side of a circuit board or substrate or on opposite sides. Here via holes may be provided e.g. to connect the antenna and the integrated circuit.

The integrated circuit and the conducting trace may be connected in various ways such as by at least an external connection, an internal connection, a circuit board trace, an electrical circuit, a capacitive device, an inductive device, a switch, a transistor, a wire bond and a (switchable) resistor. These and other options allow for a great flexibility when combing the integrated circuit and the antenna.

In some cases it may be advantageous to have the integrated circuit well separated from (but preferably still within one and the same package as) the antenna, since the antenna radiation may be absorbed by the integrated circuit and/or may disturb the circuits functioning. In this case the conducting trace is preferably not covered by said integrated circuit. In order to reduce the size it may, however, be advantageous or necessary to partially cover the conducting trace with the integrated circuit.

It is of particular advantage if the integrated circuit covers at least some or all of the feeding points of the conducting trace. Thereby it is possible to mount the integrated circuit directly on the feeding points, e.g. by soldering. The electrical connection between the antenna and the integrated circuit is thereby achieved in a relatively easy way. Due to the above mentioned radiation absorption it is further of advantage if the integrated circuit only covers the feeding points or at most the antenna portions next to the feeding points but does not cover the major part of the conducting trace.

For a proper functioning of the antenna, a proper connection of the antenna, and well defined electrical properties of such connection, may be important due to the electrical matching requirements. Here it may be advantageous to contact some or all of the feeding points at the fabrication of the antenna such that the connection is well defined. Here also after the connection tests may be performed to check for the properties of the connection. In order to select the appropriate feeding point one or more of the connections may be removed e.g. by scratching, drilling, laser ablation or the like depending on the type of connection. An antenna with small feeding points may e.g. be provided with wire bonds which connect the small feeding points to larger solder pads, pins or to contacts to an integrated circuit. Those wire bonds may be removed such that only the desired connections remain. Also by removal of a conducting trace on a circuit board by scratching, drilling or laser ablation only the desired connections may be maintained. Those connections, however, have well defined properties and therefore may not depend on the particular and unknown connection process performed by a user.

The curve defined by the conducting trace, may have a complex geometry. Possible geometries include the geometry of a space-filling curve, of a grid-dimension curve, of a box-counting curve, and of a contour-curve or the shape of a multilevel structure.

Those different geometries do not exclude each other. This means that, e.g., a space-filling curve may at the same time be a grid-dimension, a box counting, and a contour-curve, and all other ways around. Also multilevel structures and the other geometries do not exclude each other.

The complex geometry allows e.g. for multiple operating frequencies of one antenna only (even without use of the different feeding points, i.e. additional to the possibility given by the different feeding points) and further allows for a small antenna.

In a preferred embodiment the maximum extension of the conducting trace (determined by the diameter of the smallest sphere completely enclosing the conducting trace) is less than $1/5$ or $1/7$ or $1/10$ or $1/15$ or $1/20$ of the free space wavelength of the resonant (operating) frequency.

This criteria can also be used to define the terms space-filling curve, box-counting curve, grid dimension curve or contour curve. This means, that any curve with a maximum extension less than $1/5$ or $1/7$ or $1/10$ or $1/15$ or $1/20$ of the free space wavelength of the resonant (operating) frequency can be said to be a space filling curve, a box counting curve, a grid dimension curve or a contour curve.

The different geometries are discussed in the following.

Space Filling Curves

In one example, the antenna or one or more of the antenna elements or antenna parts may be miniaturized by shaping at least a portion of the conducting trace (e.g., a part of the arms of a dipole, the perimeter of the patch of a patch antenna, the slot in a slot antenna, the loop perimeter in a loop antenna, or other portions of the antenna) as a space-filling curve (SFC). Examples of space filling curves are shown in FIG. 1*b* (see curves 1501 to 1514). A SFC is a curve that is large in terms of physical length but small in terms of the area in which the curve can be included. Space filling curves fill the surface or volume where they are located in an efficient way while keeping the linear properties of being curves. In general space filling curves may be composed of straight, essentially straight and/or curved segments. More precisely, for the purposes of this patent document, a SFC may be defined as follows: a curve having at least five segments that are connected in such a way that each segment forms an angle with any adjacent segments, such that no pair of adjacent segments define a larger straight segment. In addition, a SFC does not intersect with itself at any point except possibly the initial and final point (that is, the whole curve can be arranged as a closed curve or loop, but none of the lesser parts of the curve form a closed curve or loop).

A space-filling curve can be fitted over a flat or curved surface, and due to the angles between segments, the physical length of the curve is larger than that of any straight line that can be fitted in the same area (surface) as the space-filling curve. Additionally, to shape the structure of a miniature antenna, the segments of the SFCs should be shorter than at least one fifth of the free-space operating wavelength, and possibly shorter than one tenth of the free-space operating wavelength. The space-filling curve should include at least five segments in order to provide some antenna size reduction, however a larger number of segments may be used. In general, the larger the number of segments and the narrower the angles between them, the smaller the size of the final antenna.

A SFC may also be defined as a non-periodic curve including a number of connected straight or essentially straight segments smaller than a fraction of the operating free-space wave length, where the segments are arranged in such a way that no adjacent and connected segments form another longer straight segment and wherein none of said segments intersect each other.

In one example, an antenna geometry forming a space-filling curve may include at least five segments, each of the at least five segments forming an angle with each adjacent segment in the curve, at least three of the segments being shorter than one-tenth of the longest free-space operating wavelength of the antenna. Preferably each angle between adjacent segments is less than 180° and at least two of the angles between adjacent sections are less than 115°, and at least two of the angles are not equal. The example curve fits inside a rectangular area, the longest side of the rectangular area being shorter than one-fifth of the longest free-space operating wavelength of the antenna. Some space-filling curves might approach a self-similar or self-affine curve, while some others would rather become dissimilar, that is, not displaying self-similarity or self-affinity at all (see for instance 1510, 1511, 1512).

Box-Counting Curves

In another example, the antenna or one or more of the antenna elements or antenna parts may be miniaturized by shaping at least a portion of the conducting trace to have a selected box-counting dimension. For a given geometry lying on a surface, the box-counting dimension is computed as follows. First, a grid with rectangular or substantially squared identical boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D=-\log(N2)-\log(N1)/\log(L2)-\log(L1)$$

For the purposes of this document, the box-counting dimension may be computed by placing the first and second grids inside a minimum rectangular area enclosing the conducting trace of the antenna and applying the above algorithm. The first grid in general has n×n boxes and the second grid has 2n×2n boxes matching the first grid. The first grid should be chosen such that the rectangular area is meshed in an array of at least 5×5 boxes or cells, and the second grid should be chosen such that L2=½ L1 and such that the second grid includes at least 10×10 boxes. The minimum rectangular area is an area in which there is not an entire row or column on the perimeter of the grid that does not contain any piece of the curve. Further the minimum rectangular area preferably refers to the smallest possible rectangle that completely encloses the curve or the relevant portion thereof.

An example of how the relevant grid can be determined is shown in FIG. 1 *c* to 1 *e*. In FIG. 1 *c* a box-counting curve is shown in it smallest possible rectangle that encloses that curve. The rectangle is divided in a n×n (here as an example 5×5) grid of identical rectangular cells, where each side of the cells corresponds to 1/n of the length of the parallel side of the enclosing rectangle. However, the length of any side of the rectangle (e.g. Lx or Ly in FIG. 1 *d*) may be taken for the calculation of D since the boxes of the second grid (see FIG. 1 *e*) have the same reduction factor with respect to the first grid along the sides of the rectangle in both directions (x and y direction) and hence the value of D will be the same no matter whether the shorter (Lx) or the longer (Ly) side of the rectangle is taken into account for the calculation of D. In some rare cases there may be more than one smallest possible rectangle. In this case the smallest possible rectangle giving the smaller value of D is chosen.

Alternatively the grid may be constructed such that the longer side (see left edge of rectangle in FIG. 1 *c*) of the smallest possible rectangle is divided into n equal parts (see L1 on left edge of grid in FIG. 1 *f*) and the n×n grid of squared boxes has this side in common with the smallest possible rectangle such that it covers the curve or the relevant part of the curve. In FIG. 1 *f* the grid therefore extends to the right of the common side. Here there may be some rows or columns which do not have any part of the curve inside (See the ten boxes on the right hand edge of the grid in FIG. 1 *f*). In FIG. 1 *g* the right edge of the smallest rectangle (See FIG. 1 *c*) is taken to construct the n×n grid of identical square boxes. Hence, there are two longer sides of the rectangular based on which the n×n grid of identical square boxes may be constructed and therefore preferably the grid of the two first grids giving the smaller value of D has to be taken into account.

If the value of D calculated by a first n×n grid of identical rectangular boxes (FIG. 1 *d*) inside of the smallest possible rectangle enclosing the curve and a second 2n×2n grid of identical rectangular boxes (FIG. 1 *e*) inside of the smallest possible rectangle enclosing the curve and the value of D calculated from a first n×n grid of squared identical boxes (see FIG. 1 *f* or FIG. 1 *g*) and a second 2n×2n grid of squared identical boxes where the grid has one side in common with the smallest possible rectangle, differ, then preferably the first and second grid giving the smaller value of D have to be taken into account.

Alternatively a curve may be considered as a box counting curve if there exists no first n×n grid of identical square or identical rectangular boxes and a second 2n×2n grid of identical square or identical rectangular boxes where the value of D is smaller than 1.1, 1.2, 1.25, 1.3, 1.4, 1.5, 1.6, 1.7, 1.8, 1.9, 2.0, 2.1, 2.2, 2.3, 2.4, 2.5, 2.6, 2.7, 2.8, or 2.9.

In any case, the value of n for the first grid should not be more than 5, 7, 10, 15, 20, 25, 30, 40 or 50.

The desired box-counting dimension for the curve may be selected to achieve a desired amount of miniaturization. The box-counting dimension should be larger than 1.1 in order to achieve some antenna size reduction. If a larger degree of miniaturization is desired, then a larger box-counting dimension may be selected, such as a box-counting dimension ranging from 1.5 to 2 for surface structures, while ranging up to 3 for volumetric geometries. For the purposes of this patent document, curves in which at least a portion of the geometry of the curve or the entire curve has a box-counting dimension larger than 1.1 may be referred to as box-counting curves.

For very small antennas, for example antennas that fit within a rectangle having a maximum size equal to one-twentieth the longest free-space operating wavelength of the antenna, the box-counting dimension may be computed using a finer grid. In such a case, the first grid may include a mesh of 10×10 equal cells, and the second grid may include a mesh of 20×20 equal cells. The grid-dimension (D) may then be calculated using the above equation.

In general, for a given resonant frequency of the antenna, the larger the box-counting dimension, the higher the degree of miniaturization that will be achieved by the antenna.

One way to enhance the miniaturization capabilities of the antenna (that is, reducing size while maximizing bandwidth, efficiency and gain) is to arrange the several segments of the curve of the antenna pattern in such a way that the curve intersects at least one point of at least 14 boxes of the first grid with 5×5 boxes or cells enclosing the curve. If a higher degree of miniaturization is desired, then the curve may be arranged to cross at least one of the boxes twice within the 5×5 grid, that is, the curve may include two non-adjacent portions inside at least one of the cells or boxes of the grid. The relevant grid here may be any of the above mentioned constructed grids or may be any grid. That means if any 5×5 grid exists with the curve crossing at least 14 boxes or crossing one or more boxes twice the curve may be said to be a box counting curve.

FIG. 1*a* illustrates an example of how the box-counting dimension of a curve 1 is calculated. The example curve 1 is placed under a 5×5 grid 2 (FIG. 1 *a* upper part) and under a 10×10 grid 3 (FIG. 1 *a* lower part). As illustrated, the curve 1 touches N1=25 boxes in the 5×5 grid 2 and touches N2=78 boxes in the 10×10 grid 3. In this case, the size of the boxes in the 5×5 grid 2 is twice the size of the boxes in the 10×10 grid 3. By applying the above equation, the box-counting dimension of the example curve 1 may be calculated as D=1.6415. In addition, further miniaturization is achieved in this example because the curve 1 crosses more than 14 of the 25 boxes in grid 2, and also crosses at least one box twice, that is, at least one box contains two non-adjacent segments of the curve. More specifically, the curve 1 in the illustrated example crosses twice in 13 boxes out of the 25 boxes.

The terms explained above can be also applied to curves that extend in three dimensions. If the extension in the third dimension is rather small the curve will fit into a n×n×1 arrangement of 3D-boxes (cubes of size L1×L1×L1) in a plane. Then the calculations can be performed as described above. Here the second grid will be a 2n×2n×1 grid of cuboids of size L2×L2×L1.

If the extension in the third dimension is larger a n×n×n first grid and an 2n×2n×2n second grid will be taken into account. The construction principles for the relevant grids as explained above for two dimensions apply equally in three dimensions.

Grid Dimension Curves

In another example, the antenna or one or more antenna elements or antenna parts may be miniaturized by shaping at least a portion of the conducting trace to include a grid dimension curve. For a given geometry lying on a planar or curved surface, the grid dimension of the curve may be calculated as follows. First, a grid with substantially square identical cells of size L1 is placed over the geometry of the curve, such that the grid completely covers the geometry, and the number of cells N1 that include at least a point of the geometry are counted. Second, a grid with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

For the purposes of this document, the grid dimension may be calculated by placing the first and second grids inside the minimum rectangular area enclosing the curve of the antenna and applying the above algorithm. The minimum rectangular area is an area in which there is not an entire row or column on the perimeter of the grid that does not contain any piece of the curve.

The first grid may, for example, be chosen such that the rectangular area is meshed in an array of at least 25 substantially equal preferably square cells. The second grid may, for example, be chosen such that each cell of the first grid is divided in 4 equal cells, such that the size of the new cells is L2=½ L1, and the second grid includes at least 100 cells.

Depending on the size and position of the squares of the grid the number of squares of the smallest rectangular may vary. A preferred value of the number of squares is the lowest number above or equal to the lower limit of 25 identical squares that arranged in a rectangular or square grid cover the curve or the relevant portion of the curve. This defines the size of the squares. Other preferred lower limits here are 50, 100, 200, 250, 300, 400 or 500. The grid corresponding to that number in general will be positioned such that the curve touches the minimum rectangular at two opposite sides. The grid may generally still be shifted with respect to the curve in a direction parallel to the two sides that touch the curve. Of such different grids the one with the lowest value of D is preferred. Also the grid whose minimum rectangular is touched by the curve at three sides (see as an example FIG. 1 *f* and FIG. 1 *g*) is preferred. The one that gives the lower value of D is preferred here.

The desired grid dimension for the curve may be selected to achieve a desired amount of miniaturization. The grid dimension should be larger than 1 in order to achieve some antenna size reduction. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document, a curve or a curve where at least a portion of that curve is having a grid dimension larger than 1 may be referred to as a grid dimension curve.

In general, for a given resonant frequency of the antenna, the larger the grid dimension the higher the degree of miniaturization that will be achieved by the antenna.

One example way of enhancing the miniaturization capabilities of the antenna is to arrange the several segments of the curve of the antenna pattern in such a way that the curve intersects at least one point of at least 50% of the cells of the first grid with at least 25 cells (preferably squares) enclosing the curve. In another example, a high degree of miniaturization may be achieved by arranging the antenna such that the curve crosses at least one of the cells twice within the 25 cell grid (of preferably squares), that is, the curve includes two non-adjacent portions inside at least one of the cells or cells of the grid. In general the grid may have only a line of cells but may also have at least 2 or 3 or 4 columns or rows of cells.

FIG. 2 shows an example two-dimensional antenna forming a grid dimension curve with a grid dimension of approximately two. FIG. 3 shows the antenna of FIG. 2 enclosed in a first grid having thirty-two (32) square cells, each with a length L1. FIG. 4 shows the same antenna enclosed in a second grid having one hundred twenty-eight (128) square cells, each with a length L2. The length (L1) of each square cell in the first grid is twice the length (L2) of each square cell in the second grid (L1=2×L2). An examination of FIG. 3 and FIG. 4 reveal that at least a portion of the antenna is enclosed within every square cell in both the first and second grids. Therefore, the value of N1 in the above grid dimension (Dg) equation is thirty-two (32) (i.e., the total number of cells in the first grid), and the value of N2 is one hundred twenty-eight (128) (i.e., the total number of cells in the second grid). Using the above equation, the grid dimension of the antenna may be calculated as follows:

$$D_g = -\frac{\log(128) - \log(32)}{\log(2 \times L1) - \log(L1)} = 2$$

For a more accurate calculation of the grid dimension, the number of square cells may be increased up to a maximum amount. The maximum number of cells in a grid is dependent upon the resolution of the curve. As the number of cells approaches the maximum, the grid dimension calculation becomes more accurate. If a grid having more than the maximum number of cells is selected, however, then the accuracy of the grid dimension calculation begins to decrease. Typically, the maximum number of cells in a grid is one thousand (1000).

For example, FIG. 5 shows the same antenna as of FIG. 2 enclosed in a third grid with five hundred twelve (512) square cells, each having a length L3. The length (L3) of the cells in the third grid is one half the length (L2) of the cells in the second grid, shown in FIG. 4. As noted above, a portion of the antenna is enclosed within every square cell in the second grid, thus the value of N for the second grid is one hundred twenty-eight (128). An examination of FIG. 5, however, reveals that the antenna is enclosed within only five hundred nine (509) of the five hundred twelve (512) cells of the third grid. Therefore, the value of N for the third grid is five hundred nine (509). Using FIG. 4 and FIG. 5, a more accurate value for the grid dimension (D) of the antenna may be calculated as follows:

$$D_g = -\frac{\log(509) - \log(128)}{\log(2 \times L2) - \log(L2)} \approx 1.9915$$

It should be understood that a grid-dimension curve does not need to include any straight segments. Also, some grid-dimension curves might approach a self-similar or self-affine curves, while some others would rather become dissimilar, that is, not displaying self-similarity or self-affinity at all (see for instance FIG. 2).

The terms explained above can be also applied to curves that extend in three dimensions. If the extension in the third dimension is rather small the curve will fit into an arrangement of 3D-boxes (cubes) in a plane. Then the calculations can be performed as described above. Here the second grid will be composed in the same plane of boxes with the size L2×L2×L1.

If the extension in the third dimension is larger a m×n×o first grid and an 2m×2n×2o second grid will be taken into account. The construction principles for the relevant grids as explained above for two dimensions apply equally in three dimensions. Here the minimum number of cells preferably is 25, 50, 100, 125, 250, 400, 500, 1000, 1500, 2000, 3000, 4000 or 5000.

Contour Curve

The contour-curve is defined by the ratio Q=C/E given by the ratio of the length C of the circumference of the curve and of the largest extension E of said curve. The circumference is determined by all the borders (the contour) between the inside and the outside of the curve.

The largest extension E is determined by the diameter of the smallest circle, which encloses the curve entirely.

The more complex the curve, the higher the ratio Q. A high value of Q is advantageous in terms of miniaturization.

Examples of contour-curves are shown in FIG. 6. In FIG. 6*a*, left a line 4 composed of straight or almost straight pieces is shown which represents a contour curve. The circumference C of that curve 4 is shown in FIG. 6*a*, right. The curve of a real antenna will always have a certain line thickness, so that an inner part and an outer part is given such that the circumference is determined by the border between the inner part and the outer part of the curve. The circumference C has a length which corresponds to the double of the length of the curve 4, plus twice the line thickness of that curve. The largest extension E is also shown in FIG. 6*a*, right. The ratio Q is approximately 4.9.

In FIG. 6*b*, left a contour-curve 5 is shown which has an irregular shape. The hatched area is the area of the curve. The circumference and the largest extension E are shown in FIG. 6*b*, right. The circumference here also is given by the border between the inner and the outer part of the curve 5.

In FIG. 6*c*, left a contour-curve 6 (hatched) is shown which additionally has openings 7. The border of that openings 7 contribute to the length of the circumference C (see FIG. 6*c*. right).

In FIG. 6*d* a contour curve 6' (hatched area) with openings 7' is shown in which additionally in one of the openings a further curve piece 6" (hatched) is shown, which is not in direct contact with the remainder 6' of the curve. Due to its proximity to the remainder 6' of the curve it is however electromagnetically coupled to the remainder 6' of the curve. The circumference of the piece 6" also contributes to the length C of the circumference of the curve (see FIG. 6*d*, right).

If the curve is on a folded, bent or curved or otherwise irregular surface, or is provided in any another three-dimensional fashion (i.e. it is not planar), the ratio Q is determined by the length C of the circumference of the orthogonal projection of the curve onto a planar plane. The corresponding largest extension E is also determined from this projection onto the same planar plane. The plane preferably lies in such a way in relation to the three-dimensional curve that the line, which goes along the largest extension F of the three-dimensional curve, lies in the plane (or a parallel and hence equivalent plane). The largest extension F of the three-dimensional curve lies along the line connecting the extreme points of the curve, which contact a sphere, which is given by the smallest possible sphere including the entire curve. Further the plane is oriented preferably in such a way, that the outer border of the projection of the curve onto the plane covers the largest possible area. Other preferred planes are those on which the value of C or Q of the projection onto that plane is maximized.

If for a three-dimensional curve a single projection plane is given in which the ratio Q of the projection of the curve onto the plane is larger than the specified minimal value, or this is the case for one of the above mentioned preferred projection planes the curve is said to be a contour curve. Possible minimum values for Q are 2.1, 2.25, 2.5, 2.75, 3.0, 3.1, 3.2, 3.25, 3.3, 3.5, 3.75, 4.0, 4.5, 5.0, 6, 7, 8, 9, 10, 12, 15, 20, 25, 30, 40, 50, 75, and 100.

In FIG. 6*e* an example of a three-dimensional contour curve 8 is shown. This curve is somehow undulated and shows holes 9. The projection of the curve 8 onto the planar plane 11 is shown with reference sign 10. The projection 10 includes openings corresponding to the holes 9. The ratio Q and the largest Extension E are to be determined from the projection 10. The plane 11 is chosen such that the outer border (not including the border of the holes 9) of the projection 10 covers the largest possible area onto that plane 11.

Another plane 12 is shown in FIG. 6*e* on which the curve 8 is orthogonally projected. The outer border of projection 13 on plane 12 covers an area significantly smaller than the outer border of projection 10 onto plane 11. The same applies to C and Q.

Multilevel Structures

In another example, at least a portion of the conducting trace of the antenna may be coupled, either through direct contact or electromagnetic coupling, to a conducting surface, such as a conducting polygonal or multilevel surface. Further the curve of the antenna or of the SMD component may include the shape of a multilevel structure. A multilevel structure is formed by gathering several geometrical elements such as polygons or polyhedrons of the same type or of different type (e.g., triangles, parallelepipeds, pentagons, hexagons, circles or ellipses as special limiting cases of a polygon with a large number of sides, as well as tetrahedral, hexahedra, prisms, dodecahedra, etc.) and coupling these structures to each other electromagnetically, whether by proximity or by direct contact between elements.

At least two of the elements may have a different size. However, also all elements may have the same or approximately the same size. The size of elements of a different type may be compared by comparing their largest diameter.

The majority of the component elements of a multilevel structure have more than 50% of their perimeter (for polygons) or of their surface (for polyhedrons) not in contact with any of the other elements of the structure. Thus, the component elements of a multilevel structure may typically be identified and distinguished, presenting at least two levels of detail: that of the overall structure and that of the polygon or polyhedron elements which form it. Additionally, several multilevel structures may be grouped and coupled electromagnetically to each other to form higher level structures. In a single multilevel structure, all of the component elements are polygons with the same number of sides or are polyhedrons with the same number of faces. However, this characteristic may not be true if several multilevel structures of different natures are grouped and electromagnetically coupled to form meta-structures of a higher level.

A multilevel antenna includes at least two levels of detail in the body of the antenna: that of the overall structure and that of the majority of the elements (polygons or polyhedrons) which make it up. This may be achieved by ensuring that the area of contact or intersection (if it exists) between the majority of the elements forming the antenna is only a fraction of the perimeter or surrounding area of said polygons or polyhedrons.

One example property of a multilevel antennae is that the radioelectric behavior of the antenna can be similar in more than one frequency band. Antenna input parameters (e.g., impedance) and radiation patterns remain similar for several frequency bands (i.e., the antenna has the same level of adaptation or standing wave relationship in each different band), and often the antenna presents almost identical radiation diagrams at different frequencies. The number of frequency bands is proportional to the number of scales or sizes of the polygonal elements or similar sets in which they are grouped contained in the geometry of the main radiating element.

In addition to their multiband behavior, multilevel structure antennae may have a smaller than usual size as compared to other antennae of a simpler structure. (Such as those consisting of a single polygon or polyhedron). Additionally, the edge-rich and discontinuity-rich structure of a multilevel antenna may enhance the radiation process, relatively increasing the radiation resistance of the antenna and reducing the quality factor Q i.e. increasing its bandwidth.

A multilevel antenna structure may be used in many antenna configurations, such as dipoles, monopoles, patch or microstrip antennae, coplanar antennae, reflector antennae, wound antennae, antenna arrays, or other antenna configurations. In addition, multilevel antenna structures may be formed using many manufacturing techniques, such as printing on a dielectric substrate by photolithography (printed circuit technique); dieing on metal plate, repulsion on dielectric, or others.

OTHER EMBODIMENTS

The SMD component, including a conducting trace defining an antenna element allows for the mounting of an antenna with standard mass production methods. This is to a large amount possible only due to the miniaturization of the antenna due to the complex geometry of the trace which may be a space-filling curve, a grid-dimension curve, a box counting curve or a contour-curve or the curve having the shape of a multilevel structure.

An IC-package is a device comprising an integrated circuit. Usually the integrated circuit may be enclosed by a protective material such as plastic. Contact means such as pins are accessible from the outside of the package in order to contact the integrated circuit. The IC-package here includes an antenna with a conducting trace which has a complex geometry. The conducting trace or parts thereof may also be connected to the contact means accessible from the outside of the package. The conducting trace or parts thereof may also be connected to the integrated circuit. The integrated circuit may be provided for feeding the antenna. It may also be provided for performing data processing in transmission or reception.

The conducting trace may also be connected at certain points to ground of the IC-package such that certain antenna resonance modes are suppressed or supported.

The integrated circuit may be provided with a metal frame. Such frames may be used for guiding the cutting process of the substrate of the IC-package. The frame preferably has gaps which reduce currents flowing on the frame.

The wireless device has one or more of the above-mentioned antennae and/or one or more of the above-mentioned SMD components and/or one or more of the above mentioned IC-packages.

The antenna or the antenna element of the SMD or the antenna of the IC-package can be contacted in different ways. It is possible to contact only one feeding point so that by appropriate selection of the feeding point, the desired resonant frequency or any other desired antenna characteristic is given.

In a preferred embodiment, two or three or more feeding points/access ports/feeding purposes points are electrically contacted to other electric circuits of the wireless device such that the used feeding point can be selected after the production of the wireless device by an, e.g. electrical switch. This switch may be mechanically operated or electrically operated, such as a transistor or a combination of transistors or the like. The antenna may be connected to an integrated circuit (e.g. the one of the IC-package or any other integrated circuit of the wireless device) which feeds the antenna and/or which connects separated parts of the antenna.

With two, three or more feeding points/access ports electrically contacted, it is also possible not only to use a single feeding point, but also to provide energy to the antenna at two, three or more feeding points at the same time. By using different amounts of energy provided to the different feeding points, antenna characteristics such as resonant frequency, impedance, bandwidth and efficiency may be adjusted continuously.

By selecting a specific contacting mode, the antenna may be operated at resonance at different operating frequencies. This allows for adaptation of the wireless device to different wireless communication systems. Also by connecting one or more feeding points to ground of the wireless device it is possible to select certain antenna properties.

In a preferred embodiment, for at least a part of the antenna and/or the SMD component and/or the IC-package a space is provided between the antenna and/or the SMD component and/or the IC-package to any other member or constructive element of the wireless device, such that the electrical characteristics of the antenna and/or antenna element and/or IC-package can be maintained after mounting the antenna and/or the SMD component and/or IC-package. A space is in particular useful if the conducting trace is provided on one side of a substrate or circuit board and this side of the substrate faces a circuit board to which substrate or circuit board is mounted. The conducting trace is then protected by the space from mechanical impact by the circuit board due to e.g. scratching. The other side of the antenna or the SMD component may be in contact to other parts of the wireless device.

Even if the antenna and/or the SMD component and/or the IC-package allow for different operating frequencies, it may be in a preferred embodiment desirable to have two, three or more antennae or SMD components with an antenna element or IC-packages. Thereby, it is possible to provide even more operating frequencies to the wireless device. Further it is possible to operate the wireless device simultaneously at two, three or more different operating frequencies using the two, three or more different antennae and/or antenna elements. Also this is interesting for a wireless device featuring diversity and/or multiple input multiple output (MIMO) functionalities. Here at least some of the antennae have the same resonant frequency.

In order to physically hold the antenna or the SMD component or IC-package within the wireless device, it may be possible to use the feeding points, which are not electrically contacted. This may be done, e.g., by soldering the feeding (purposes) point or the access port to a circuit board, where, however, the metallic part of the circuit board has no further electrical connections such that the feeding point is not used to feed energy to the conducting trace or to ground the conducting trace.

The conducting trace is provided in the wireless device, such that a ground plane of the wireless device does not cover the antenna. This allows for a good emission of the radiation by the antenna.

The method allows for selection of the desired antenna property (e.g. the desired resonant frequency) by selecting the appropriate feeding point.

Preferred embodiments of the invention are disclosed in the figures. It is shown in:

FIG. 1 examples of how to calculate the box counting dimension, and examples 1501 through 1514 of space filling curves for antenna design (FIG. 1 *b*);

FIG. 2 an example of a curve featuring a grid-dimension larger than 1, referred to herein as a grid-dimension curve;

FIG. 3 the curve of FIG. 2 in the 32 cell grid, wherein the curve crosses all 32 cells and therefore N1=32;

FIG. 4 the curve of FIG. 2 in a 128 cell grid, wherein the curve crosses all 128 cells and therefore N2=128;

FIG. 5 the curve of FIG. 2 in a 512 cell grid, wherein the curve crosses at least one point of 509 cells;

FIG. 6 examples of how to determine the ratio Q for contour-curves;

FIG. 7 different basic configurations of antennae;

FIG. 8 an antenna geometry including different possible feeding pads;

FIG. 9 a view of the antenna mounted on a regular ground plane (left) and a view of three different feeding configurations of the antenna (right);

FIG. 10 typical return loss and efficiency for the antenna, including different feeding points (top and bottom, respectively);

FIG. 11 a view of a rectangular light switch (top) and two example configurations for a tunable antenna with multiple feed points in a wireless light switch (bottom);

FIG. 12 typical return loss (top) and efficiency (bottom) for a tunable antenna with multiple feeding points mounted on a rectangular light switch;

FIG. 13 schematic views of a 2.4 GHz USB dongle (left), a 2.4 GHz wireless car kit (center), and a 2.4 GHz headset (right), using an antenna with multiple feed points;

FIG. 14 schematic view of a 2.4 GHz-5 GHz WLAN wireless PCMCIA card using an antenna arrangement (two antennas) with multiple feed points;

FIG. 15 at top and bottom view (left/right) of an SMD component;

FIG. 16 a schematic, exploded view of an antenna/SMD component;

FIG. 17 a front view of a surface mounted antenna/SMD component;

FIG. 18 an example of a tape and reel packaging of antennae/SMD components (Embossed Tape and Reel Data Carrier Tape Specifications);

FIG. 19 a schematic view of an IC-package;

FIG. 20 a schematic view of an IC package containing an antenna, integrated on an application PCB. The placement of the package is chosen to optimize the performance of the FWSIP module on the board, while minimizing the ground plane clearance;

FIG. 21 a schematic view of an IC package containing an antenna with several possible feeding points, integrated on an application PCB;

FIG. 22 Typical return loss and efficiency obtained for the antenna of FIG. 21 when fed at each one of the available ports;

FIG. 23 an Example of the IC package with integrated antenna of FIG. 19 configured as IFA antenna to better adapt its performance to the PCB ground plane requirements. The figure on right-hand side shows a detailed view of the antenna and the ports used for feeding and grounding;

FIG. 24 a typical return loss and Smith chart diagram obtained for the antenna of FIG. 19 when configured as monopole (Feeding at port #4) or IFA (Feeding at port #3 and grounding at port #1) on a PCB as shown in FIG. 23;

FIG. 25 an embodiment of a package containing a chip and an antenna with two feeding points. Depending on the placement of the IC package on the PCB one feed point or the other is selected;

FIG. 26 a schematic view of an IC-package with 5 separated parts of an antenna;

FIG. 27 a schematic view of an IC-package in which the chip or die is located at the center and surrounded by a conducting trace with a loop geometry;

FIG. 28 an IC package with an integrated antenna having a metal frame around to determine the extension of the package substrate: (a) Continuous frame; (b) Frame with one gap on each one of its edges; and (c) Frame with three gaps on each one of its edges;

FIG. 29 typical return loss and efficiency for a GPS antenna integrated in an IC package in which there is a metal frame on its perimeter. The curves show the variation of the performance of the antenna when gaps are applied in the frame;

FIG. 30 a Bluetooth™ FWSiP module integrated on the bottom right corner of the PCB of a handset. The inset in the figure shows the orientation of the antenna and the clearance required;

FIG. 31 typical return loss and efficiency for the Bluetooth™ antenna integrated in an IC package when mounted on the PCB of a handset;

FIG. 32 a Bluetooth™ FWSiP module integrated on the central part of the PCB of a handset. The inset in the figure shows the orientation of the antenna and the clearance required;

FIG. 33 application examples for an IC package containing an antenna: (a) View of a USB dongle containing a FWSiP module in its recommended position on the ground plane; and (b) View of a rectangular light switch, above, and possible placement of FWSiP module on the PCB.

FIG. 7 *a* shows a schematic example of an antenna 14. The antenna 14 has three feeding points 16*a*, 16*b*, 16*c* which here have as an example only, the shape of a square and may be used as solder pads. Between feeding point 16*a* and 16*b*, only schematically the connection of the two feeding points is indicated by the dotted line 15*a*. Here the dotted line 15*a* is shown as a straight line and is supposed to be substituted by a complex curve such as a space-filling curve, a grid-dimension curve, a box-counting curve, a contour-curve or curve having the shape of a multilevel structure. Equally, the connection between feeding point 16*b* and 16*c* is shown schematically only by the dotted line 15*b* which may be appropriately substituted by a more complex curve such as a space-filling curve, a grid-dimension curve, a box counting curve, a contour-curve or a curve having the shape of a multilevel structure. In FIG. 7 *a*, in one of the feeding points 16*b*, the two portions 15*a* and 15*b* are both connected to that feeding point 16*b*. The other feeding points 16*a* and 16*c* are provided at the end of the conducting trace 15. It is also possible to have the conducting trace 15 in such a way that at one end or at two or three or more ends of the conducting trace 15 no feeding point is provided. This may be achieved by omitting the feeding point 16*a* or 16*c* or by, e.g., moving the feeding point 16*a* or 16*c* towards the feeding point 16*b* along the conducting trace. The three feeding points 16*a*, 16*b* and 16*c* do not necessarily have to be aligned as shown in FIG. 7 *a*.

A possible configuration of the antenna 14 is also given by the configuration shown in FIG. 7 *a*, where the feeding point 16*a* and the trace portion 15*a* are omitted.

Another connection mode of the three feeding points 16*a*, 16*b*, 16*c* is shown in FIG. 7 *b*. The three feeding points 16*a*, 16*b* and 16*c* are connected in a Y-branch style. The dotted lines here have to be considered as being substituted by complex curves such as a space-filling curve, a grid-dimension curve, a box-counting curve, a contour-curve or a curve having the shape of a multilevel structure. If the connection between feeding point 16*a* and 16*b* is regarded as one radiating arm the connection between feeding point 16*c* and the radiating arm is a second radiating arm.

More radiating arms and/or more feeding points may be added to the connection modes shown in FIG. 7 *a* or 7 *b*.

In FIG. 7 *c* a general case of an antenna with separated parts of blocks (15*a*, 15*b*, 15*c*, 15*d*) is shown. Each separated part has at least one contact means (16*a*, 16*b*, 16*c*, 16*d*, 16*e*, 16*f*). Some separated parts have two or only one contact means. Also three or more contact means are possible for one separated part (not shown). The different parts may be connected together in order to construct a desired antenna configuration. The three parts 15*a*, 15*b*, 15*c*, may be connected one after the other so that a long antenna is achieved. Also a Y-branch configuration is possible e.g. by connecting contact means 16*d*, 16*e* and 16*f* together. Some parts may not be connected at all. Then the antenna is shorter. Also only one separated part e.g. 15*a* or 15*b* may be used. They provide for different resonant frequencies. In summary any possible connection or not-connection of the different separated parts is possible. In FIG. 7 *c* the dotted parts are to be considered as representatives of curves with a complex geometry.

FIG. 8 illustrates an example tunable antenna 21 having multiple feeding points. The example antenna of FIG. 8 includes a conducting trace 20 attached to a dielectric substrate 22. The conducting trace 20 may, for example, be made of copper, aluminum, brass, silver, gold, or some other type of good conducting alloy. The substrate 22 may, for example, be a PCB material, such as plastic, epoxy, FR4, glass fiber, ceramic (LTCC, HTCC), glass, semiconductor, or other materials. The conducting trace 20 may be fabricated on one or more layers of the dielectric substrate 22 using standard PCB manufacturing processes, such as thick film processes (printing, etching) or thin film processes.

The conducting trace 20 defines at least one curve with two ends. One of the ends of the conducting trace 20 may include a connection or feeding port, as illustrated in FIG. 8. In addition, the conducting trace 20 includes one or a plurality of feeding points or ports at one, two or more points along the trace. The feeding points may, for example, be formed using soldering pads, solder balls, solder pins, wire-bonds coupled to other input/output pins of the PCB package, or some other means for connecting to the conducting trace. The operating characteristics of the antenna are dependent upon which of the feeding points is used to feed the antenna. Thus, each of the feeding points may be accessed, such that a user may chose the feeding point that best tunes the characteristics of the antenna to suit the device in which the antenna will be mounted. For example, different feeding points may be selected in order to tune the impedance, bandwidth, efficiency and resonant frequency of the antenna.

For miniaturization purposes, at least a portion of the curve defining the conducting trace may be shaped as a space-filling curve, a box-counting, or grid-dimension curve, or a fractal based curve or as a contour-curve or have the shape of a multilevel structure. The conducting trace may include a single radiating arm, or may branch-out in two or more radiating arms. The conducting trace may also be coupled, either through direct contact or electromagnetic coupling, to a conducting polygonal or multilevel surface.

Referring again to FIG. 8, the antenna geometry includes different pads along its path, and each pad can be used as a feeding point. Depending on the chosen feeding pad, the electrical antenna length changes. For instance, if the antenna is fed at pad 17, then the resonating path of the antenna is smaller than if the antenna is fed at pad 18. Thus, the antenna may be tuned to a higher resonant frequency by selecting pad 17 as the antenna feeding point.

In one example, the pads connected along the path of the antenna which are not used to feed the antenna may be used as attachment pads.

In the example of FIG. 8, the antenna is a monopole antenna and its geometry is a space-filling shape. In another example, the same antenna structure could be used as a dipole element.

In FIG. 8 a pad is provided which has no contact to any other pad or the conducting trace. This pad may be used as an attachment pad, by, e.g. soldering it to a circuit board. This use as an attachment pad has no electrical effect and allows only for a mechanical holding of the substrate 22 to the circuit board.

FIG. 9 illustrates an example in which the antenna is a discrete component 21 mounted on a PCB. The antenna may be manufactured to be a discrete component using, for instance, a dielectric substrate material. Three different feeding configurations of the antenna are depicted in the example of FIG. 9. In the example of FIG. 9, the antenna geometry is not visible because the antenna geometry is etched on the other side of the dielectric component.

Example characteristics of an antenna mounted as shown in FIG. 9 are illustrated in FIG. 10. FIG. 10 shows graphs of three curves. The long dashed curve corresponds to the antenna fed at point 18, the continuous curve with the feeding at point 17, and the short dashed curve using the feeding point 19. As illustrated, the resonance can be tuned by choosing the feeding point. This behavior is completely different from e.g. a linear monopole antenna, where the resonant frequency does not depend on the end at which the monopole is contacted. Here, however, the resonant frequency is different for contacting the trace 20 at the end pad 18 or at the end pad 22. This behavior can be found in a similar way for the other claimed and mentioned curve geometries or shapes.

While in FIG. 9, on the right-hand side only the case of contacting one of the possible feeding points is shown, it is also possible to have two or three of the feeding points contacted at the same time.

FIG. 11 shows an example of a wireless light switch that incorporates a tunable antenna as described herein. It should be understood, that other wireless light switch designs could also be used, such as differently-shaped light switches. The ground plane of the example switch may be totally or partially filled, depending on the switch configuration.

FIG. 12 shows an example return loss and efficiency of a tunable antenna with multiple feeding points mounted on the totally filled ground plane of FIG. 11. In this example, only one feed point (pad no. 18) is considered. As can be seen the electric antenna properties are different from those of FIG. 10 due to the different environments of the antennae. The antennae themselves of the measurements of FIG. 10 or 12 are similar. With the different feeding points such frequency shifts, efficiency changes, impedance changes or bandwidth changes can be at least partially compensated.

One possible application of the multi-feed antenna is an antenna for GPS systems. Depending on the chosen antenna feeding point it can either cover the 1.575 GHz band or the 1.227 GHz frequency band.

Some additional example applications for a tunable antenna having multiple feeding points are illustrated in FIGS. 13 and 14. The car kit refers e.g. to a part which may be placed inside or onto a holding device which can be stuck to the inside of a windscreen to hold a mirror. The car kit may also be placed e.g. inside a head rest in order to receive audio data for a loudspeaker. In the car kit part an antenna for GPS, radio, mobile communication or other any other wireless communication system may be placed. The Figure shows the circuit board of an example car kit.

Example Methods for Manufacturing Tunable Antenna Component

Following is a description of several possible methods and processes for manufacturing a tunable antenna component with multiple feeding points, as described herein.

In one example, the antenna can be manufactured to be a SMT or SMD component. In this case, the antenna may be etched on a dielectric substrate, such as FR4, Neltek, Rogers or an equivalent material.

In other examples, ceramic, deposited materials and LCP could also be used. Different package manufacturing technologies, such as thin film and thick-film, can be used. A variety of package architectures are also possible, such as DIP, QFP, PGA, BGA, CSP or others.

The following example data is related to the mechanical aspects for manufacturing of the antenna product as a SMT or SMD component.

An example of an antenna is shown in FIG. 15. On the left hand side the top side is shown and on the right hand side the bottom side is shown. Three square shaped feeding points or access ports are shown in three corners of the square shaped antenna (see FIG. 15, right).

Example Specifications for Dielectric

| | |
|---|---|
| Material | Neltec NH9338ST0813RHRH |
| $\epsilon_r$ | 3.38 ± 0.04 |
| Tan loss | 0.00025 |

Example Specifications for Metal Laminate:

| | |
|---|---|
| Material | Copper foil, 15 μm, 17 μm, 20 μm or 25 μm.<br>Tined Pads |

Example Specifications for Cover Lay:

| | |
|---|---|
| Top | Blue silkscreen ink cover, 25 μm, 30 μm or 40 μm.<br>White silkscreen ink "logo", 25 μm, 30 μm or 40 μm. |
| Bottom | Black silkscreen ink cover, 50 μm to 100 μm.<br>White silkscreen ink "xyz" 25 μm, 30 μm or 40 μm. |

Example Specifications for INK

| | |
|---|---|
| Blue (pantone 312) | Blue CARAPACE EMP 110-3245 |
| Black | Black Taiyo PSR4000 |

The exploded view of the layers of an antenna is shown in FIG. 16. In the middle a 0.8 mm Neltec substrate is shown on which a 17 μm thick copper layer is provided from which the antenna and the pads are fabricated. In other examples a 1.0 mm thick substrate is used. The thickness of the copper layer may be varied between 15 to 30 μm. On top of the substrate two ink layers are provided. Below the copper layer two ink layers are provided which provide for different effects. Firstly they give an optical appearance to the device. Secondly they electrically insulate the copper layer and lastly they provide a mask which allows electrical access to the feeding points (here pads). The ink mask is in particular useful for soldering the antenna, since it defines the area where the solder shall or may contact the antenna.

Example Assembly Process:

As a SMT or SMD component, an example assembly process flow is as follows. First, a solder paste may be applied to the mounting pads on the printed wiring board and the devices are placed thereon, and then soldered. When simultaneous reflow for double-sided surface mounting or flow soldering is performed, a temporary adhesive may be used to affix the devices to the printed wiring board before the soldering is performed. A cleaning process may be performed to remove the residual flux, etc., after the soldering process is performed, after which an inspection may be performed. A baking process may be performed before soldering when a moisture-removal treatment is required when a plastic package is used FIG. 17 shows an example where an antenna is mounted an a circuit board (PCB). A space of 0.1 mm is provided between the antenna and the PCB. At the area of the feeding points or access ports solder is provided to electrically bridge the space between the PCB and the antenna to electrically contact the antenna. Where there is no solder the space is empty. The space may also be less or more than 0.01, 0.05 0.2, 0.5 or 1.0 mm.

Example Environmental Integrity Test

The example antenna maintains all the dimensions and electric characteristic in the range that tests IEC 68-2-56 (humidity) and IEC 68-2-1.2 (temperature) operate.

Packing Example

The antennas may, for example, be delivered in tape and reel. FIG. 18 shows an example of a tape and reel packaging.

FIG. 19 illustrates an example IC package having an integrated antenna. Also shown on the example IC package are a semiconductor die or chip (IC chip) and a plurality of bonding pads. The antenna is illustrated in the top region of the package, the IC chip in the lower left corner and the bonding pads distributed over the IC-package.

The antenna is formed from a conducting trace attached to a surface of the IC package. The antenna may, for example, be attached to the dielectric or semiconductor substrate of the package. The conducting trace may, for example, be made of copper, aluminum, brass, silver, gold or some other good conducting alloy. The substrate material to which the antenna is attached may, for example, be a PCB material, such as a low cost material based on plastic, epoxy, FR4, fiber glass or laminate materials or a more sophisticated material such as ceramic (LTCC, HTCC), glass, or semiconductor materials.

The conductive trace may, for example, be fabricated on at least one of the layers of the substrate by a standard manufacturing process, such as thick film processes (printing, etching) or thin film processes.

The antenna includes a plurality of possible feed points (see feeding points # 1-# 5 in FIG. 19) along the conducting trace at which the antenna may be accessed, each of which may be configured as the feed point of the antenna by connecting the feed point to a bonding pad. The bonding pad couples the antenna feed point to the IC chip. The connection between the antenna feed point and the IC chip may, for example, be through an external or internal PCB trace, through an external bypass, and/or through a circuit including other electrical and/or RF components. It should be understood that the bonding pads may be metallic pads, solder balls, solder pins, wire-bond connections, or other input/output devices for an IC package.

The conductive trace of the antenna defines one or more curves (the term curve as used herein may include curved and/or straight segments.) In some examples, for miniaturization purposes, at least a portion of the curve(s) defining the conducting trace may define a space-filling curve, a box-counting curve, a grid-dimension curve, a fractal based curve and/or a contour curve, or have the shape of a multilevel structure, as described above. In some examples, the conductive trace may define a single curve, while in other examples it may define two or more curves, each of which may include a space-filling curve, box-counting curve, grid-dimension curve, a fractal based curve and/or a contour curve or have the shape of a multilevel structure. Additionally, in some examples a portion of the curve(s) may be coupled either through direct contact or electromagnetic coupling to a multilevel structure, as described above.

The IC package may provide access to the multiple feed points of the antenna from outside of the package. In this manner, the end-user can choose the proper port for feeding the antenna and/or define the connectivity among the other ports to optimally tune the antenna in terms of resonance frequency and impedance, for example to a wireless device in which the IC package is mounted. By providing user access to the multiple feed points, a single package layout can be standardized and used in a wide range of applications, for example in different devices with different form factors (such as laptops, PDAs, MP3 players, handsets, GPS navigators, multimedia terminals, etc.), and in different geographical domains with different spectrum allocations for wireless terminals.

Also it may be possible that no direct access to the feed points is given from the outside. In this case the antenna is connected to the chip which feeds and controls the antenna. The antenna is therefore contacted indirectly from the outside through the chip.

In some arrangements, one or more of the several ports at which the antenna can be accessed through pads of the package may be used as short-circuit points for the antenna, that is points that are connected to an internal ground plane of the package or to the external ground plane on the PCB of the device in which the IC package is mounted. Thus, the same antenna geometry can be arranged for instance as a monopole antenna or as an inverted-F antenna (IFA/PIFA). The IFA configuration of the antenna can be advantageous for some types of ground planes on which the antenna impedance is capacitive.

The configurability of the antenna may provide the end-user with extra degrees of freedom to adjust for instance the resonance frequency, input impedance, bandwidth, gain, efficiency and radiation pattern of the antenna to an even wider variety of application environments with PCBs of many different sizes, shapes and clearances.

In some examples, the antenna geometry may include several separated parts, or blocks, not necessarily equal, each one containing at least one point that can be accessed from the outside of the package, for instance through a pad, or from the chip. Depending on the PCB on which the AiP (Antenna in Package) module is mounted, the antenna feeding point, the connections between different parts of the antenna, and whether these parts are connected to ground or not can be selected to optimize the resonance frequency, the input impedance and/or the bandwidth of the antenna. In some examples, antenna geometries may also include parasitic elements.

The assembly of a die or chip to the substrate of a FWSiP/FWSoC module may result in the substrate becoming warped. This problem can be of especially concern in Multi-Chip Modules (MCMs). When reflowing a chip onto a package substrate, the cycle of heating and subsequent cooling of the surfaces that come together upon assembly may develop stresses on the substrate due to the differences between the thermal expansion coefficient of the material of the substrate and that of the chip. If the substrate is not rigid enough, it will become warped compromising the planarity, and hence the solderability, of the resulting FWSiP/FWSoC module.

The warpage effect is more typically severe in thin substrates, particularly when the chip is positioned in a corner of the substrate to leave room for the antenna. Reinforcement of the substrate may be necessary to avoid this problem. This can be achieved by placing an extra layer of dielectric material on top of the antenna. The detuning of the resonance frequency of the antenna can be corrected by selecting the appropriate feeding pad.

In some examples, the geometry of the antenna may be such that it is convenient to substantially arrange the die or chip at the center of the substrate and reserve the outer perimeter region of the substrate for the footprint of the antenna. Such an arrangement may minimize the warpage of the substrate for a given thickness, as the stresses produced by the assembly of the chip are more uniformly distributed.

Some semiconductor and/or package fabrication technologies use a frame to delimitate the area of the die or the substrate. Such a frame is typically used as a reference when cutting a semiconductor wafer or a laminate substrate panel with high degree of accuracy. This frame is often made of lossy metals (for instance tantalum), which can compromise the frequency tuning, bandwidth and/or radiation performance of the antenna integrated in the package, as the currents induced on the conductive frame may tend to cancel those of the antenna. This problem may be reduced or eliminated by including gaps along the perimeter of the frame, because the presence of discontinuities on the frame makes it difficult for currents to be induced, while still providing guidance for the cutting process.

FIG. 20 shows an example of an IC package having a miniature antenna and an IC chip integrated on a PCB. The antenna in this example (illustrated in the upper right corner of the PCB) includes a portion that this shaped as a space-filling curve and a portion that extends from the space-filling curve portion to a feed point. Other feed points may be provided here to which the antenna extends with a certain portion. The IC chip is illustrated in the lower left corner of the IC package. The PCB substrate is partially covered by a ground plane (illustrated as the mayor part on the PCB). The exposed portion of the PCB substrate (i.e., the portion that is not covered by the ground plane) is also shown and located in the upper right corner of the PCB close to the IC-package. The border between the part of the PCB that is covered by the ground plane and the part not covered by the ground plane is indicated by a dashed line. The PCB may, for example, be a 1 mm thick PCB for a wireless device, in which a substantial portion of the PCB substrate is covered by a ground plane.

The IC package is attached to the PCB substrate such that the antenna footprint is included entirely within the exposed portion of the PCB substrate, with the tip of the antenna positioned at the upper right corner of the PCB substrate in order to provide as much clearance as possible between the tip of the antenna and the PCB ground plane. Positioning the IC package at the corner of the PCB substrate enables the tip of the antenna to be positioned away from the PCB ground plane, while minimizing the amount of exposed PCB substrate. That is, the IC package position allows a maximum amount of the PCB substrate to be covered by the ground plane, while still achieving the improved antenna performance resulting from positioning the tip of the antenna at a distance away from the PCB ground plane.

FIG. 21 shows another example of an IC package that integrates a miniature antenna and an IC chip on the same substrate. This example is similar to the example of FIG. 20, using the example antenna shown in FIG. 19. As described above, this example antenna includes multiple feed points, each of which may be configured as the feed point for the antenna. The electrical length of the antenna differs depending on the chosen feeding point. For instance, if the antenna of FIG. 19 is fed at feeding point 2, then the resonating path of the antenna is smaller than if the antenna is fed at feeding point 1. This permits a higher resonance frequency if the antenna is fed at feeding point 2. FIG. 21 shows an advantageous placement of the IC package of FIG. 19 on a PCB with a substantial area of the PCB covered by a ground plane.

In the example of FIG. 21, the bonding pads connected at the feeding points along the path of the antenna which are not used to feed the antenna act simply as fixation pads to provide mechanical stability to the package. The example antenna illustrated in FIG. 21 is a monopole and its geometry is a space-filling shape. The same antenna can be used as a dipole element.

FIG. 22 illustrates example performance characteristics of the antenna of FIG. 21. FIG. 22 includes two graphs, each graph containing five curves corresponding to the five feed points of the antenna. FIG. 22 illustrates how the resonance can be tuned by choosing the feeding point from the lowest resonance frequency (at feed point 1) to the highest (at feed point 5).

FIG. 23 illustrates the same IC package as shown in FIG. 22 attached to a PCB having a differently shaped ground plane. The border of the ground plane on the PCB is again indicated by a dashed line. This example illustrates the adaptability of the antenna integrated in the IC package. In this particular example, it may be advantageous to configure the antenna as an inverted F antenna (IFA) by selecting the proper points for feeding and grounding.

In other examples, the miniature antenna may include several pads for feeding and/or grounding along the antenna path. In order to achieve the desired performance, the antenna could be grounded at more than one of the pads connected along to its path.

FIG. 24 compares the typical performance of the antenna when mounted on a PCB with a ground plane as depicted in FIG. 23, when configured as monopole (feeding at point 4) and as IFA (feeding at point 3 and grounding at point 1). It is observed that the IFA configuration is better matched to the particularities of this ground plane.

The arrangement of the antenna inside the IC package in the example of FIG. 20 makes it advantageous to mount the IC package on the upper right corner of the PCB, such that the tip of the antenna is at a maximum distance from the ground plane. However, if the package illustrated in FIG. 20 were mounted on the upper left corner of the PCB such that the tip of the antenna was closest to the ground plane, then the antenna may exhibit decreased performance unless the ground plane clearance is increased. FIG. 25 illustrates an example antenna with two feeding points. Depending on the placement of the package on the PCB, one feed point or the other can be selected in order to achieve a maximum possible distance between the tip of the antenna and the ground plane. The symmetry of the geometry and the flexibility of the design of the antenna makes the resulting FWSoC/FWSiP more versatile.

FIG. 26 illustrates an example IC package that includes a plurality of separate antenna geometries (antenna parts or blocks). The antenna blocks may each have different sizes and geometries, including space-filling curves, grid dimension curves, box counting curves and/or contour curves or have the shape of a multilevel structure. In other examples, two or more of the antenna blocks may have the same antenna geometry and/or size. The antenna blocks include at least one feed point that can be accessed from the outside of the package through a pad or is connected to a chip. The interconnections between different blocks of the antenna can be defined to optimize the antenna parameters for a particular ground plane. In the same way, the optimal feeding point can be selected among the different available pads.

In one example, the interconnection between two or more of the antenna blocks of FIG. 26 may include a reactive element, either capacitive or inductive. In another example, the antenna resulting from the interconnection of two or more of the antenna blocks of FIG. 26 may be grounded by at least one pad connected to one block that constitutes the antenna. In another example, one or more of the antenna blocks in FIG. 26 may be used to create a parasitic element electromagnetically coupled with the set of blocks that form the main antenna element connected to the feeding point.

FIG. 27 illustrates an example IC package in which the chip or die is located at the center of the PCB substrate and the antenna footprint in located in the outside perimeter of the package. The antenna path forms a loop with different pads along its path available to be used as feed points. Schematically two wire bonds are shown which connect the integrated circuit with two feeding points of the loop. Also more wire bonds that connect the chip with the conducting trace may be provided. It may also be possible to connect all feeding points of the conducting trace with the integrated circuit and to remove some of the connections later in order to select to desired connections.

FIG. 28 *a* shows an IC package substrate that contains an antenna and a metal frame on its perimeter that is used as a reference to cut a single IC substrate out of a panel. FIGS. 28 *b* and 28 *c* show the same IC package substrate in which one gap and three gaps, respectively, have been created on each side of the square metal frame.

FIG. 29 illustrates the improved antenna performance created by including gaps in the metal frame, as illustrated in FIGS. 28 *b* and 28 *c*. The typical performance of the antenna is illustrated in FIG. 29, showing the antenna performance with no frame (continuous line), with a frame having no gaps (short dashed line), with a frame having one (1) gap (dashed dotted line) and with a frame having three (3) gaps (long dashed line.) The results show that the performance that the antenna exhibited in a package without metal frame may be substantially restored by introducing the gaps in the metal frame.

Example Applications

The flexible design of the antenna, and its careful integration in the IC package, and on the PCB, make it possible to use this FWSiP solution in a wide set of wireless connectivity applications. Some example target market segments where it can be used include: Bluetooth™ enabled handsets, Mini-PCI (Notebook PC with Wi-Fi module integrated), Compact flash wireless cards, Wireless USB/UART dongles, PCMCIA wireless cards, Headsets, Pocket PC with integrated Wi-Fi, Access points for hot-spots, Wireless switches, or Wireless sensors.

FIG. 30 shows an example of a Bluetooth™ enabled handset that uses a FWSiP solution. The device is mounted in the lower right corner of the handset. The area requirements on the handset (Bluetooth™ chipset+antenna+clearance) of a FWSiP solution could represent substantial area savings over the conventional solution.

Figure 1A:
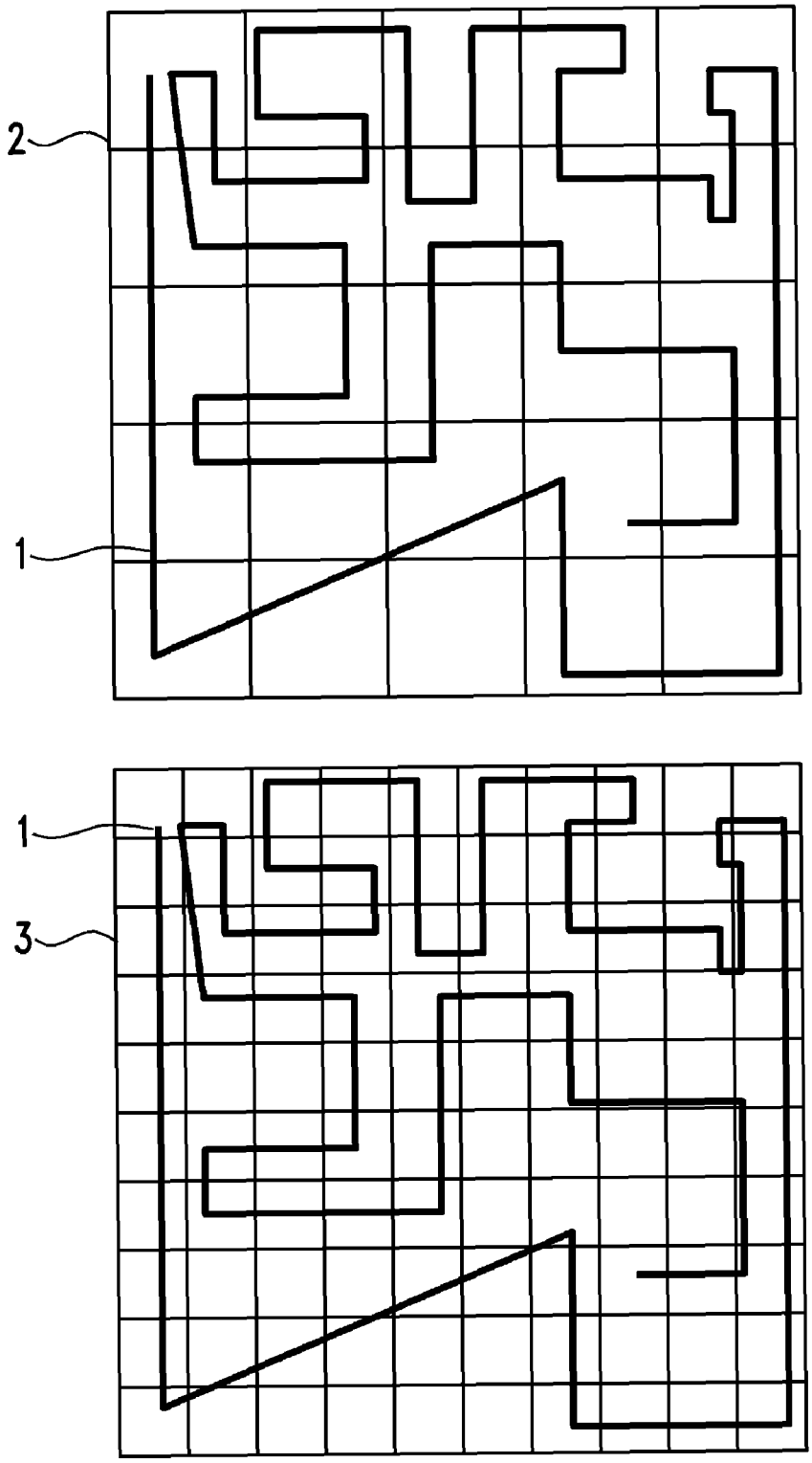
Figure 1B:
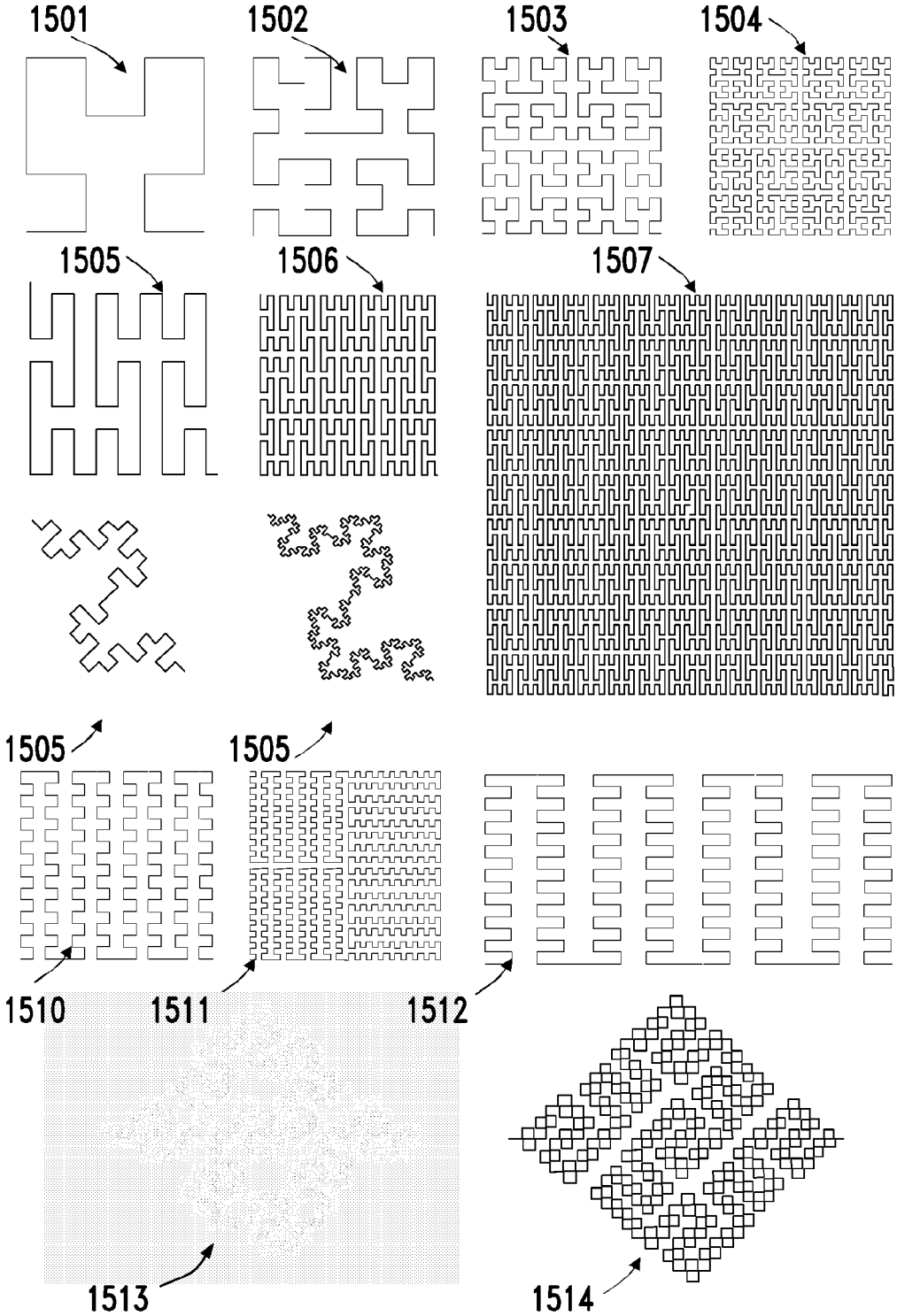
Figures 1C, 1D, 1E:
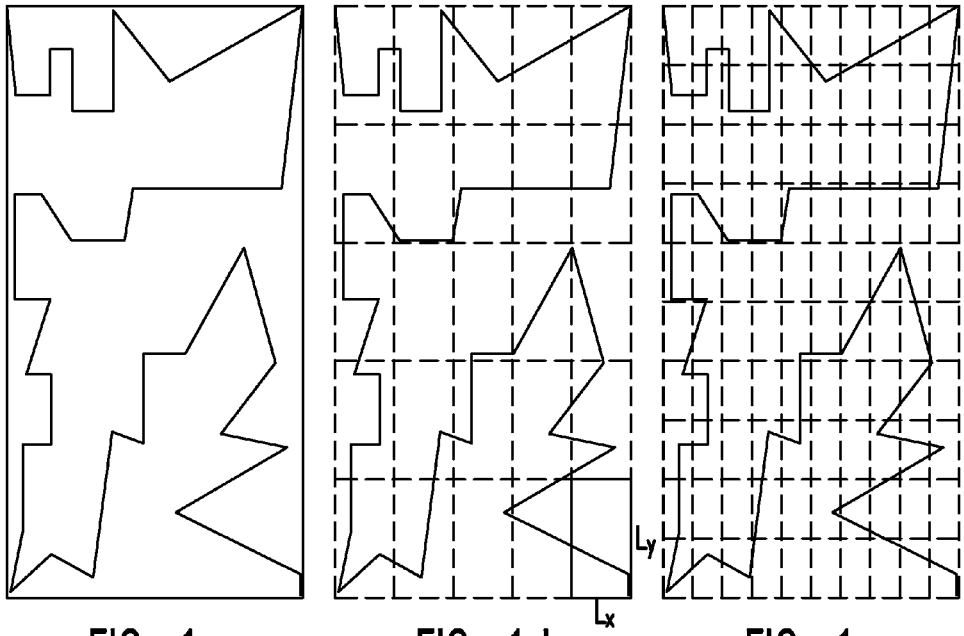
Figure 1F:
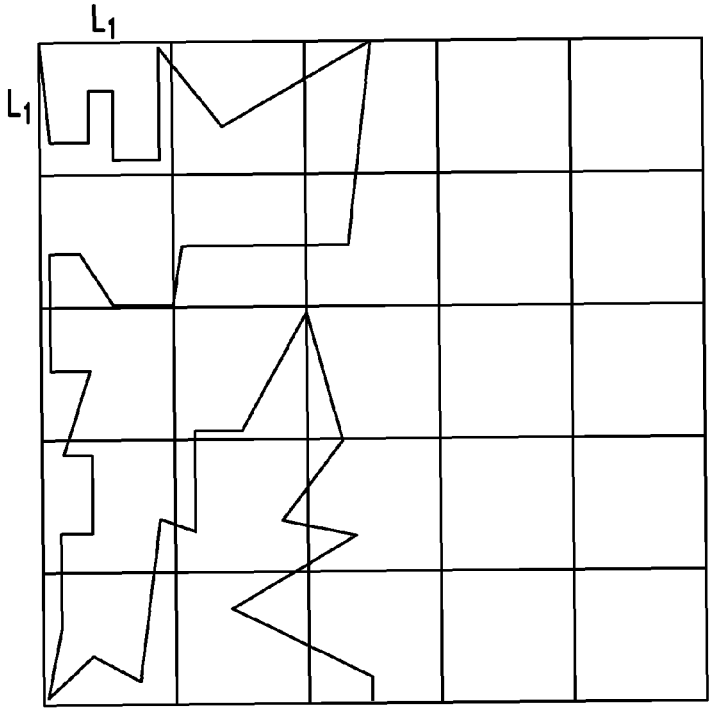
Figure 1G:
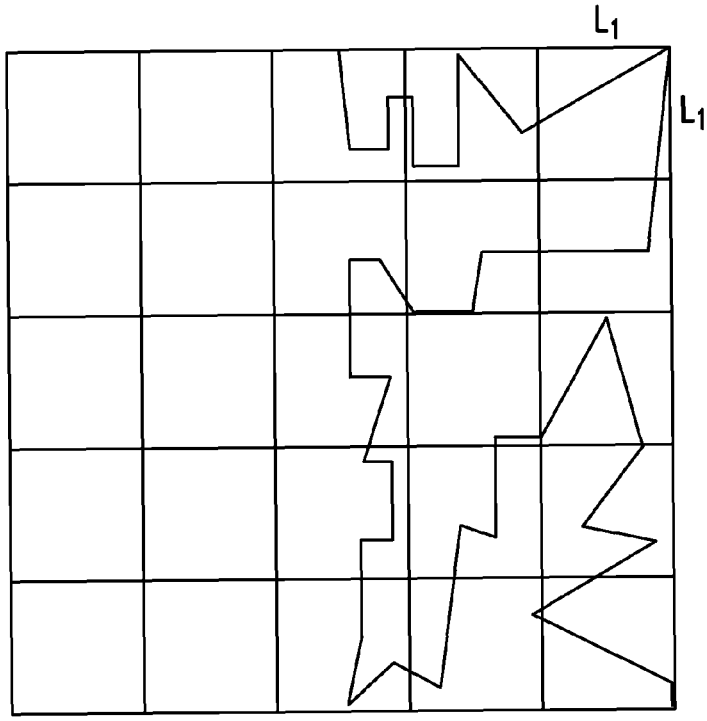
Figure 2:
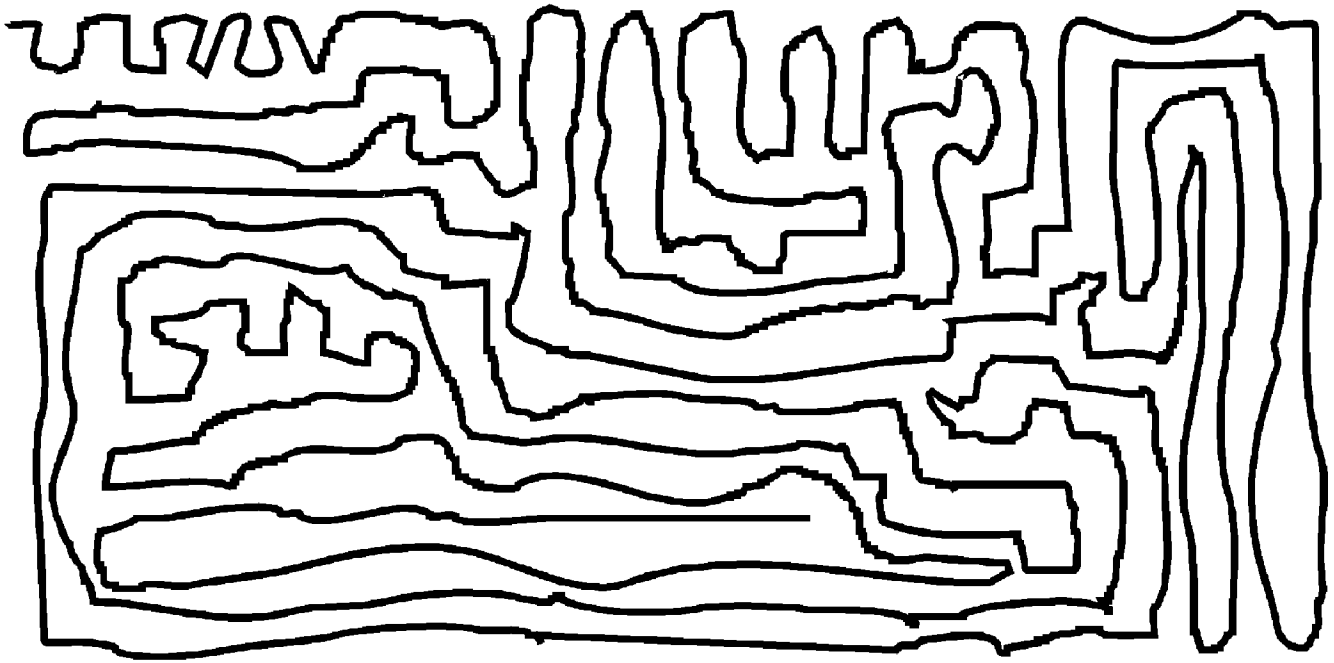
Figure 3:
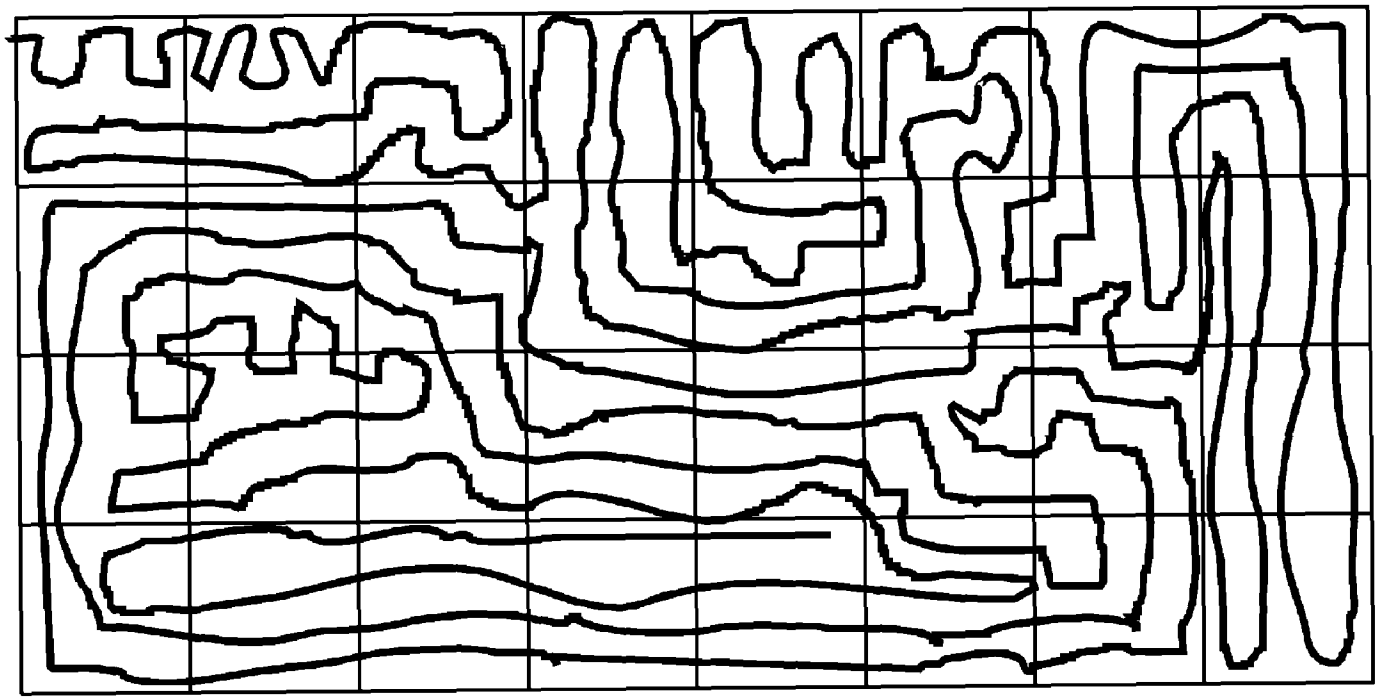
Figure 4:
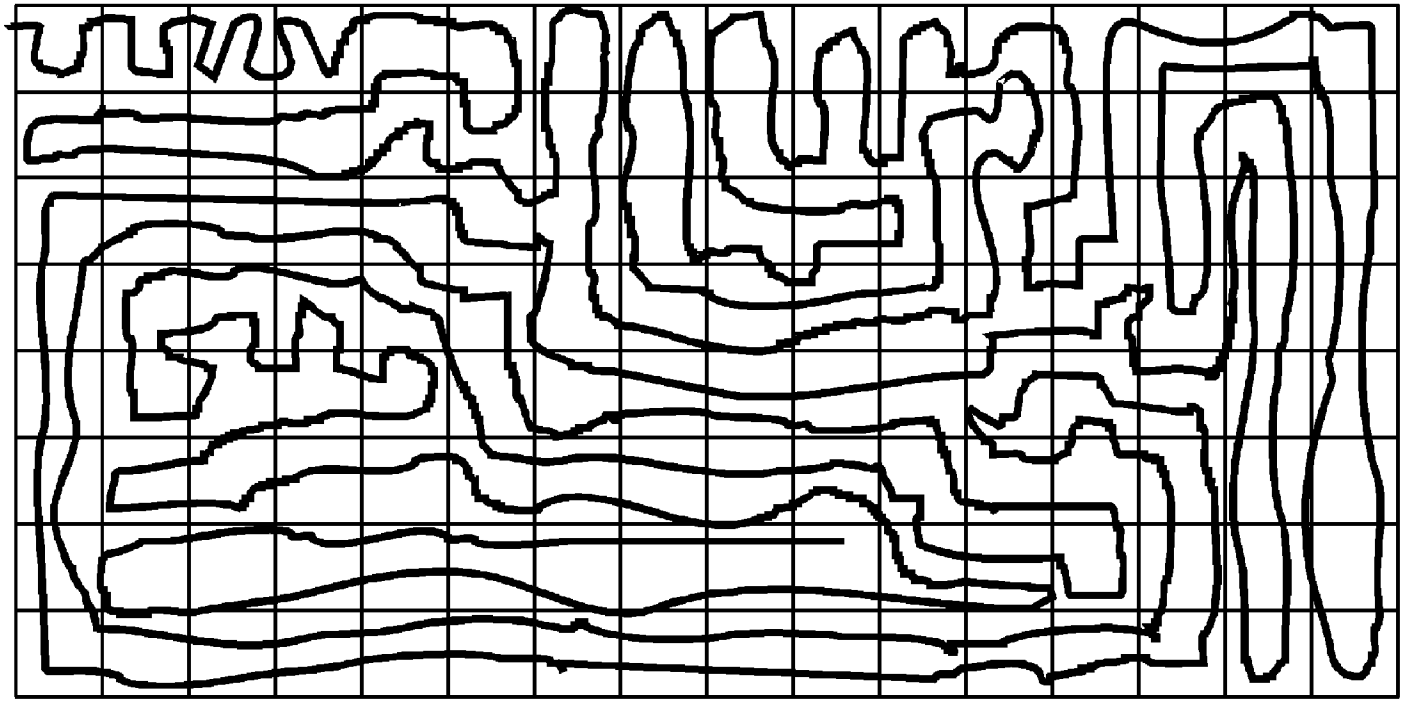
Figure 5:
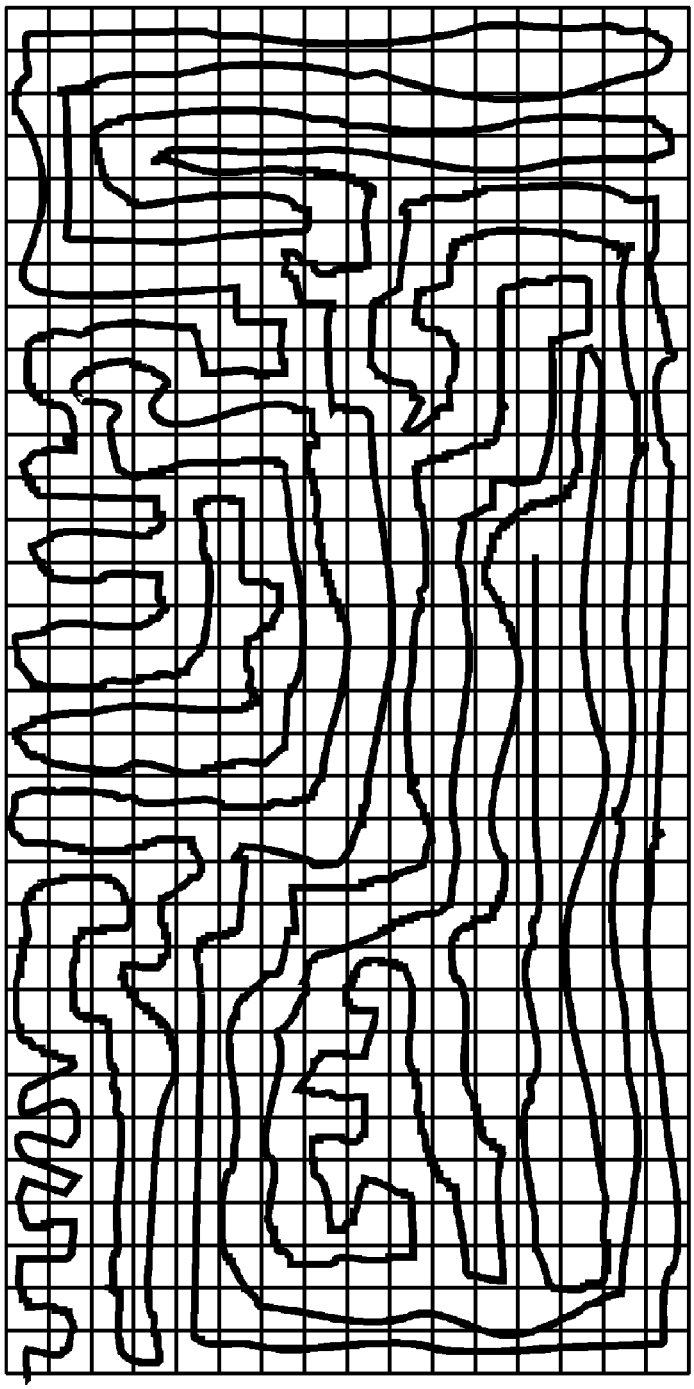
Figure 6A:
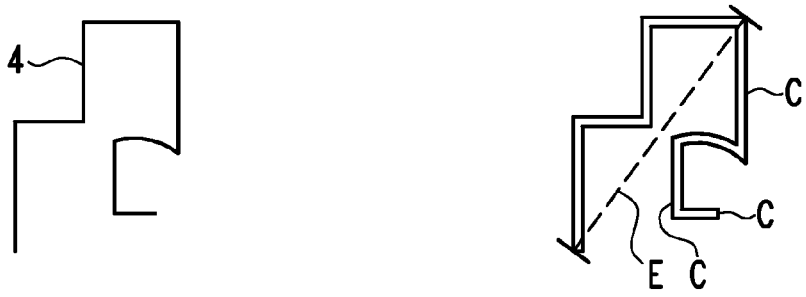
Figure 6B:
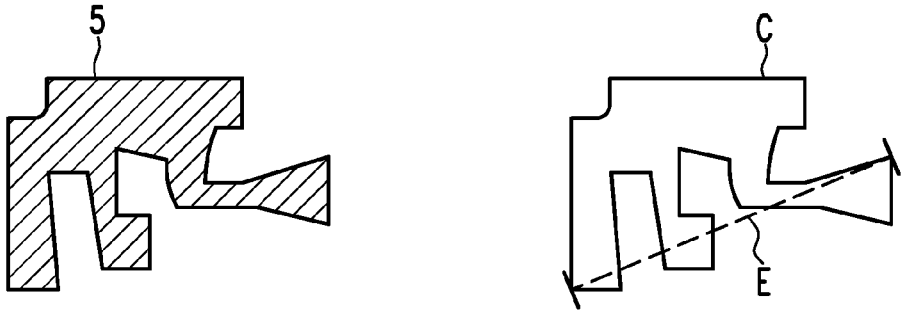
Figure 6C:
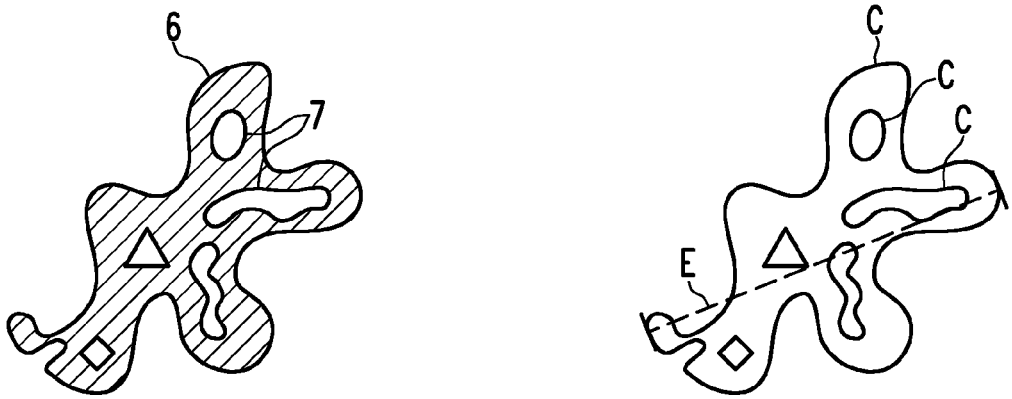
Figure 6D:
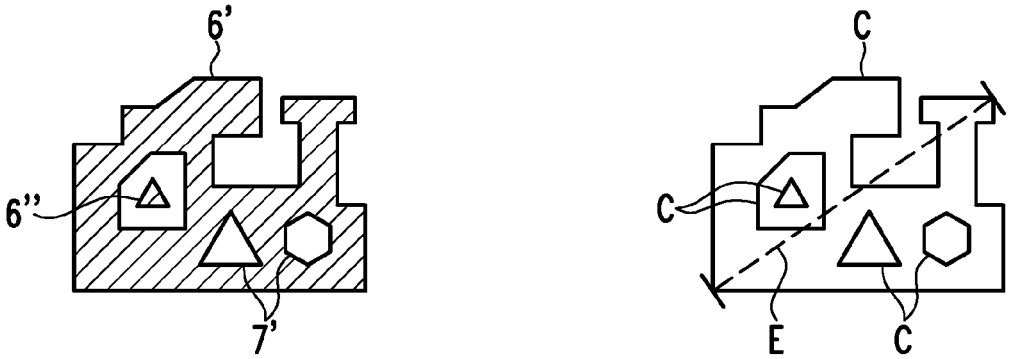
Figure 6E:
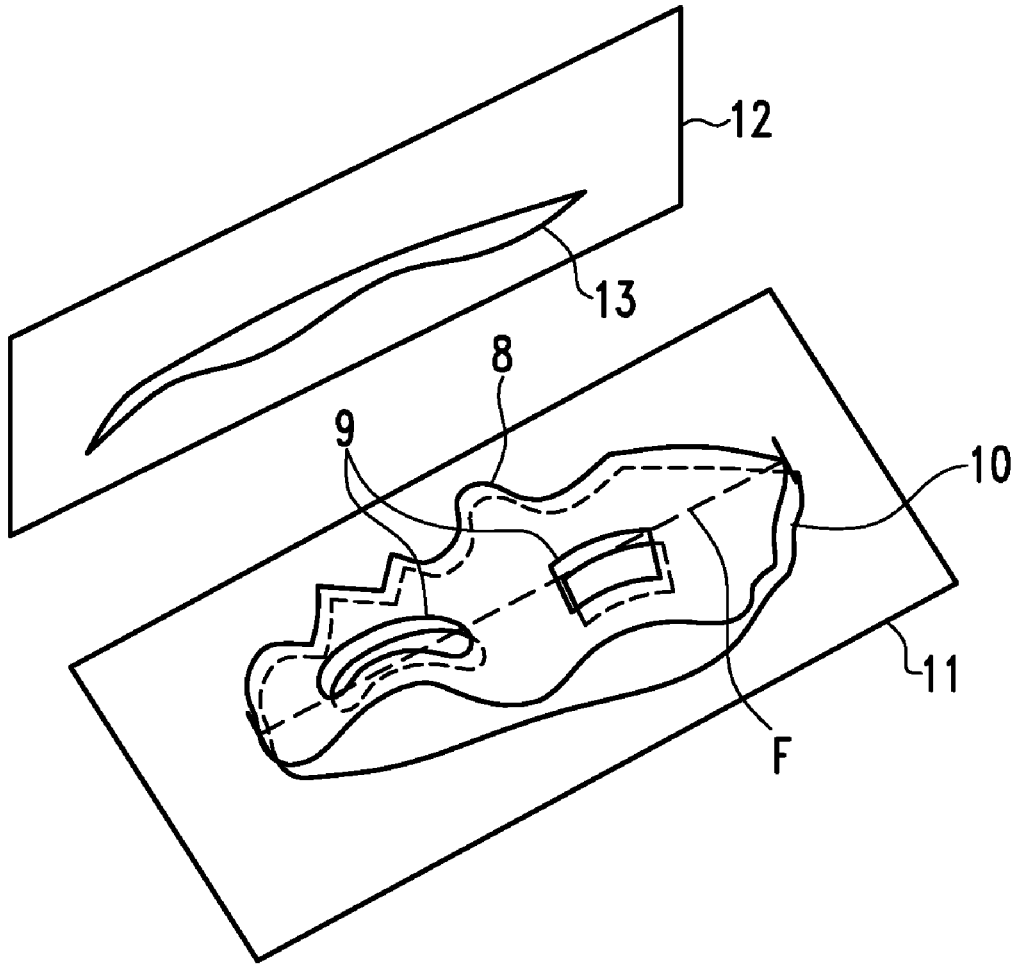
Figure 7A:
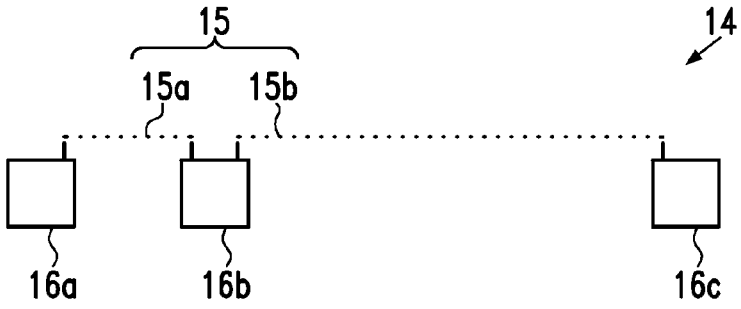
Figure 7B:
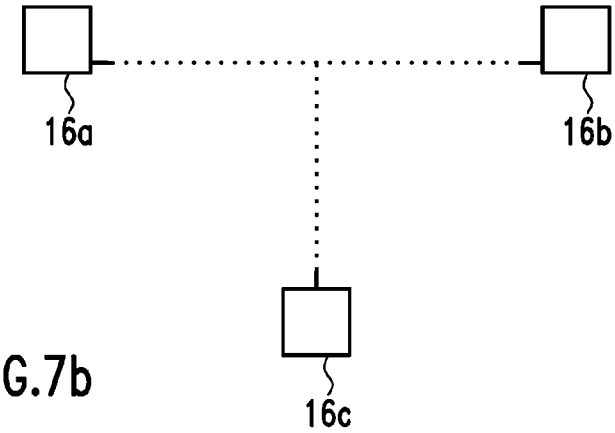
Figure 7C:
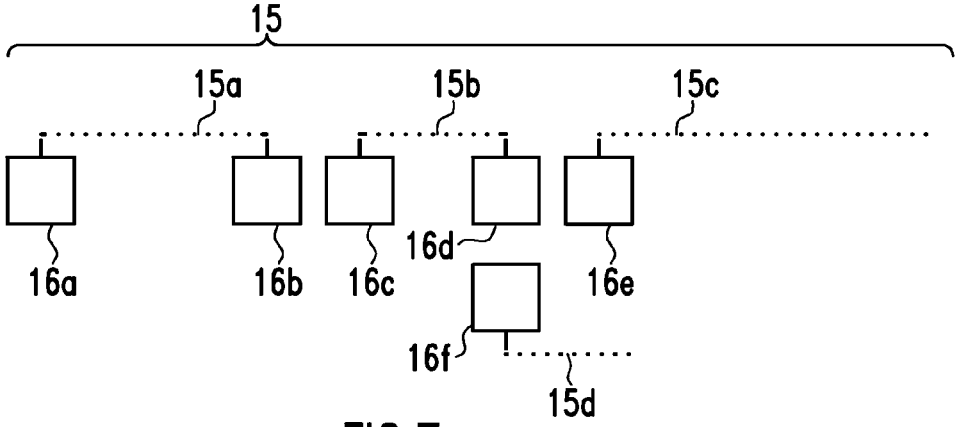
Figure 8:
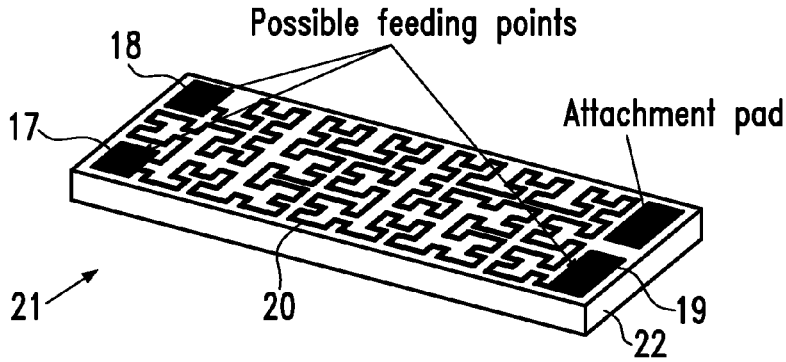
Figure 9:
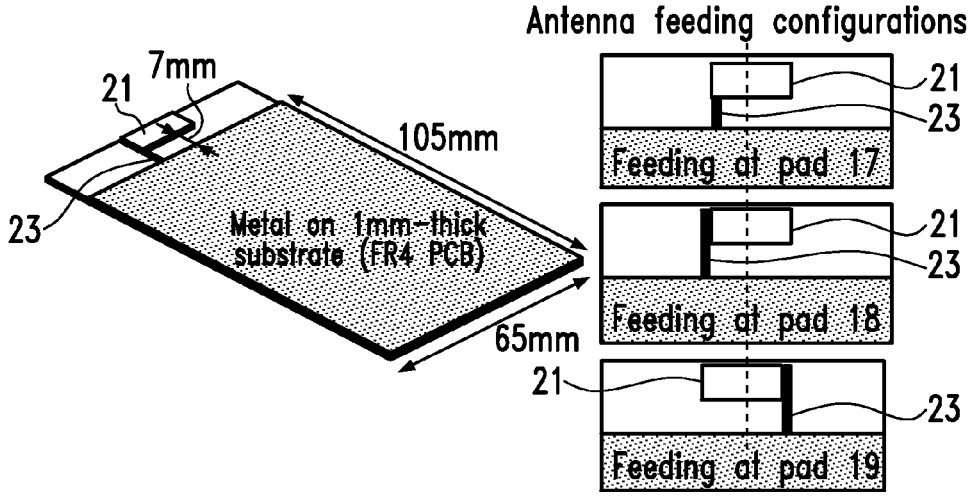
Figure 10:
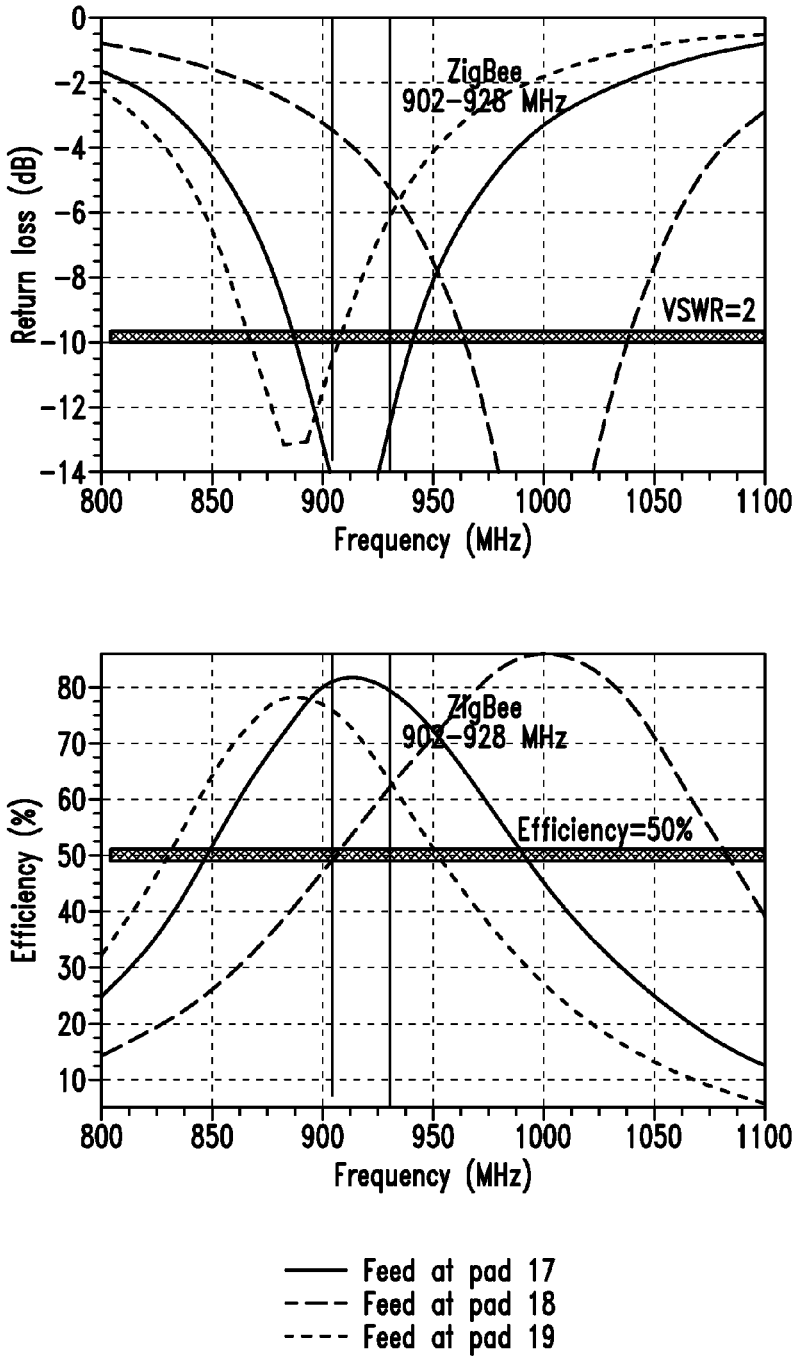
Figure 11:
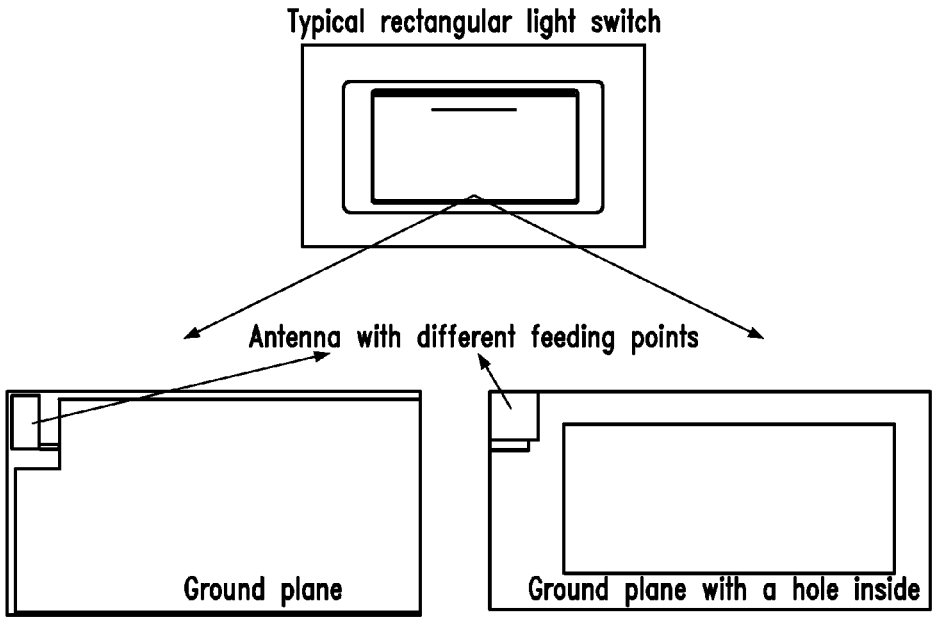
Figure 12:
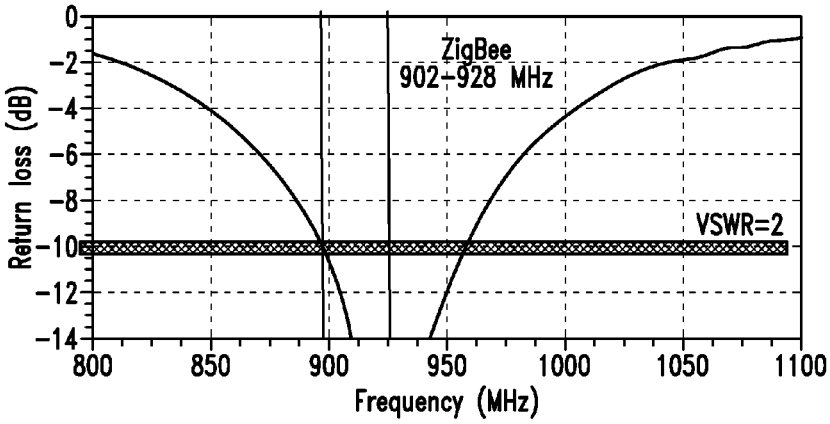
Figure 12:
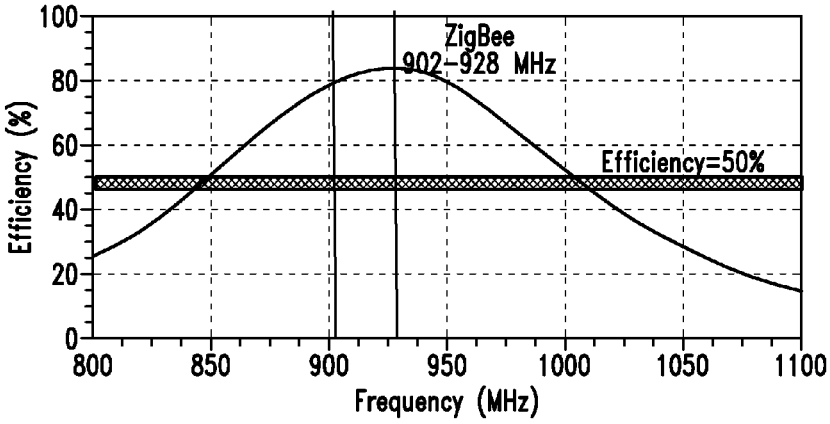
Figure 13:
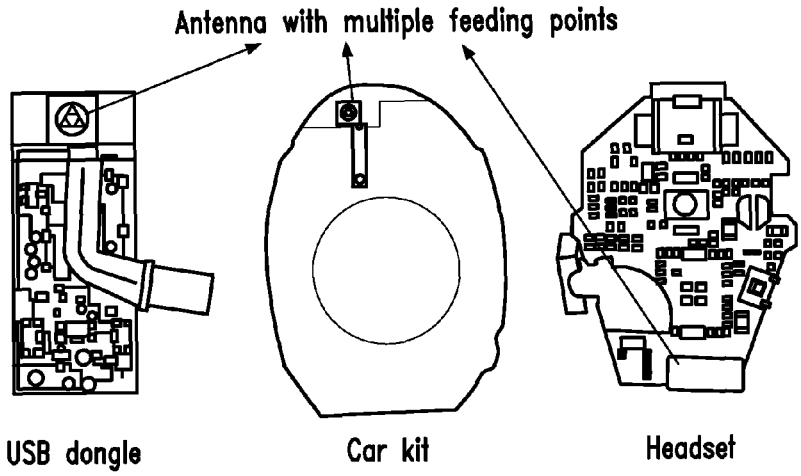
Figure 14:
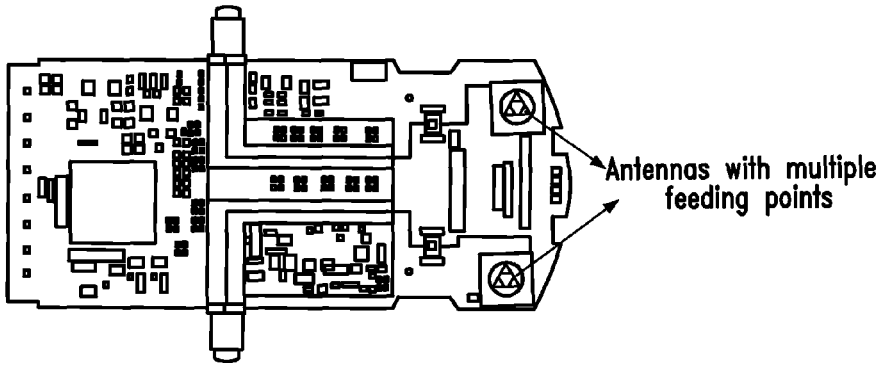
Figure 15:
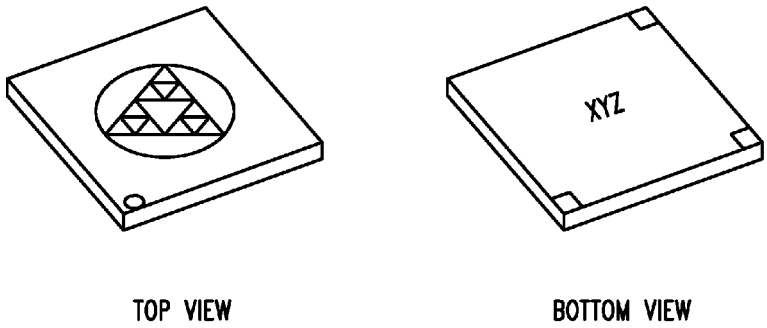
Figure 16:
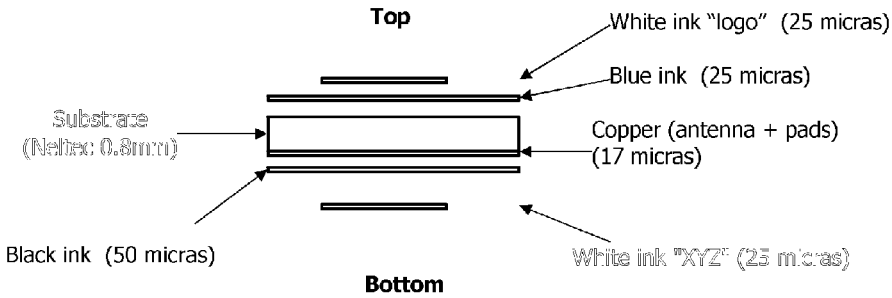
Figure 17:
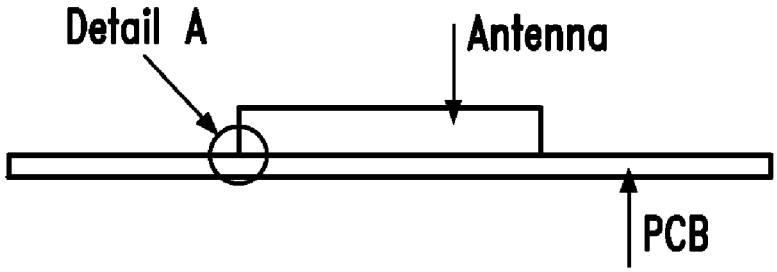
Figure 17:
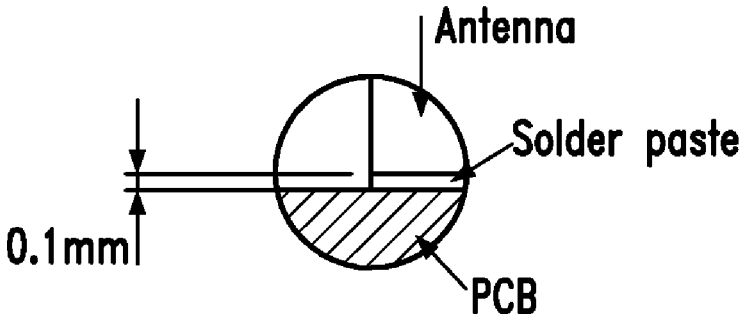
Figure 18:
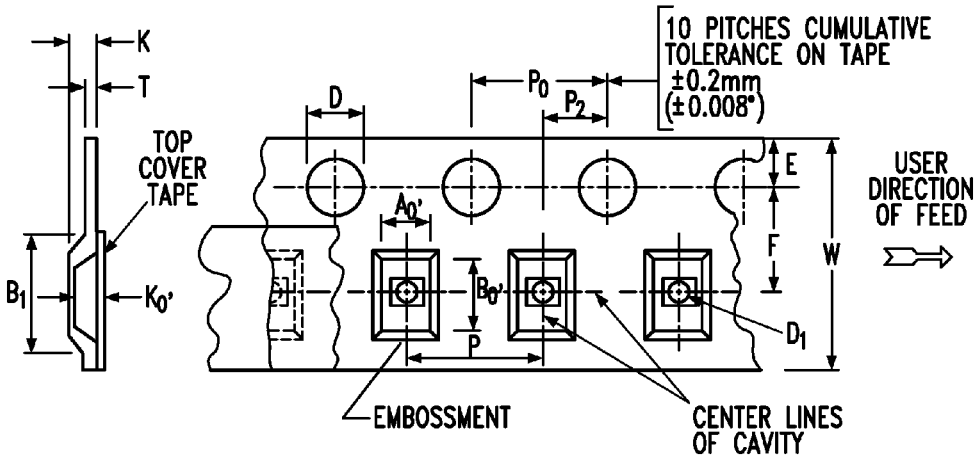
Figure 18:
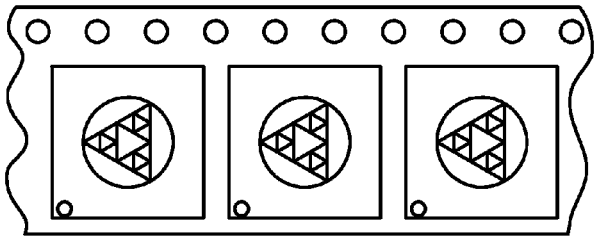
Figure 18:
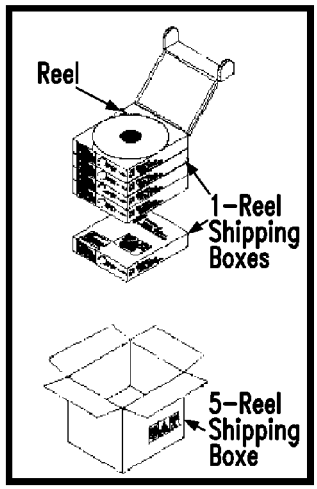
Figure 19:
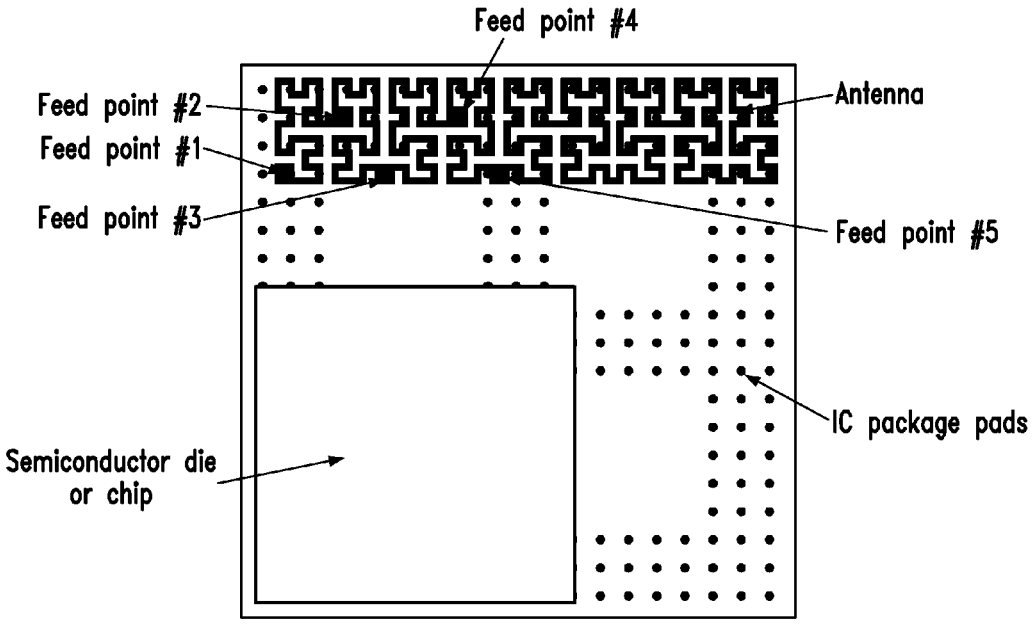
Figure 20:
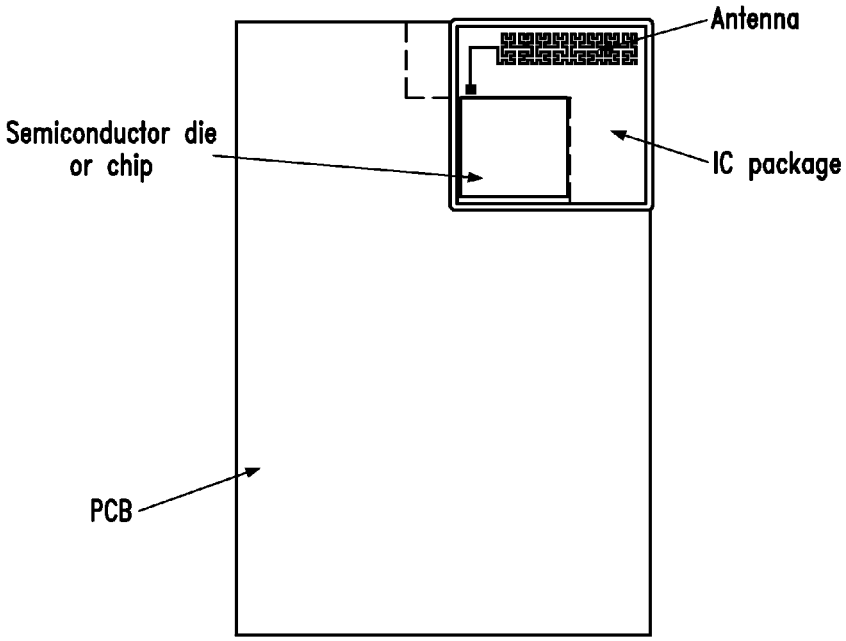
Figure 21:
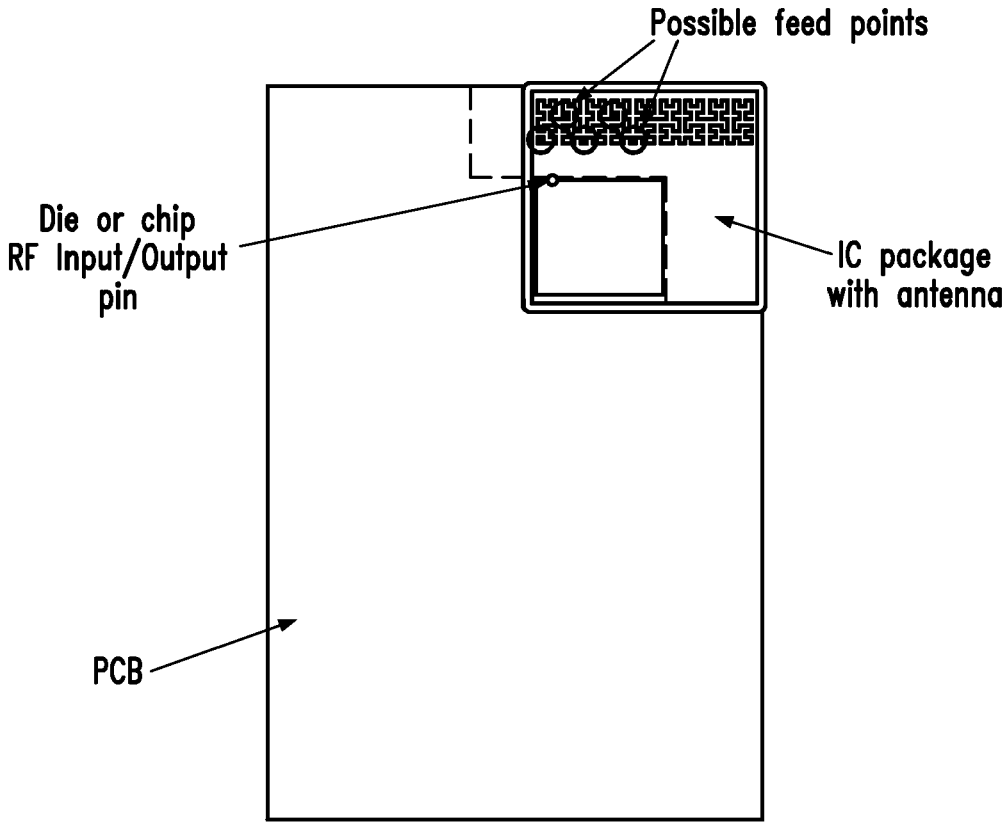
Figure 22:
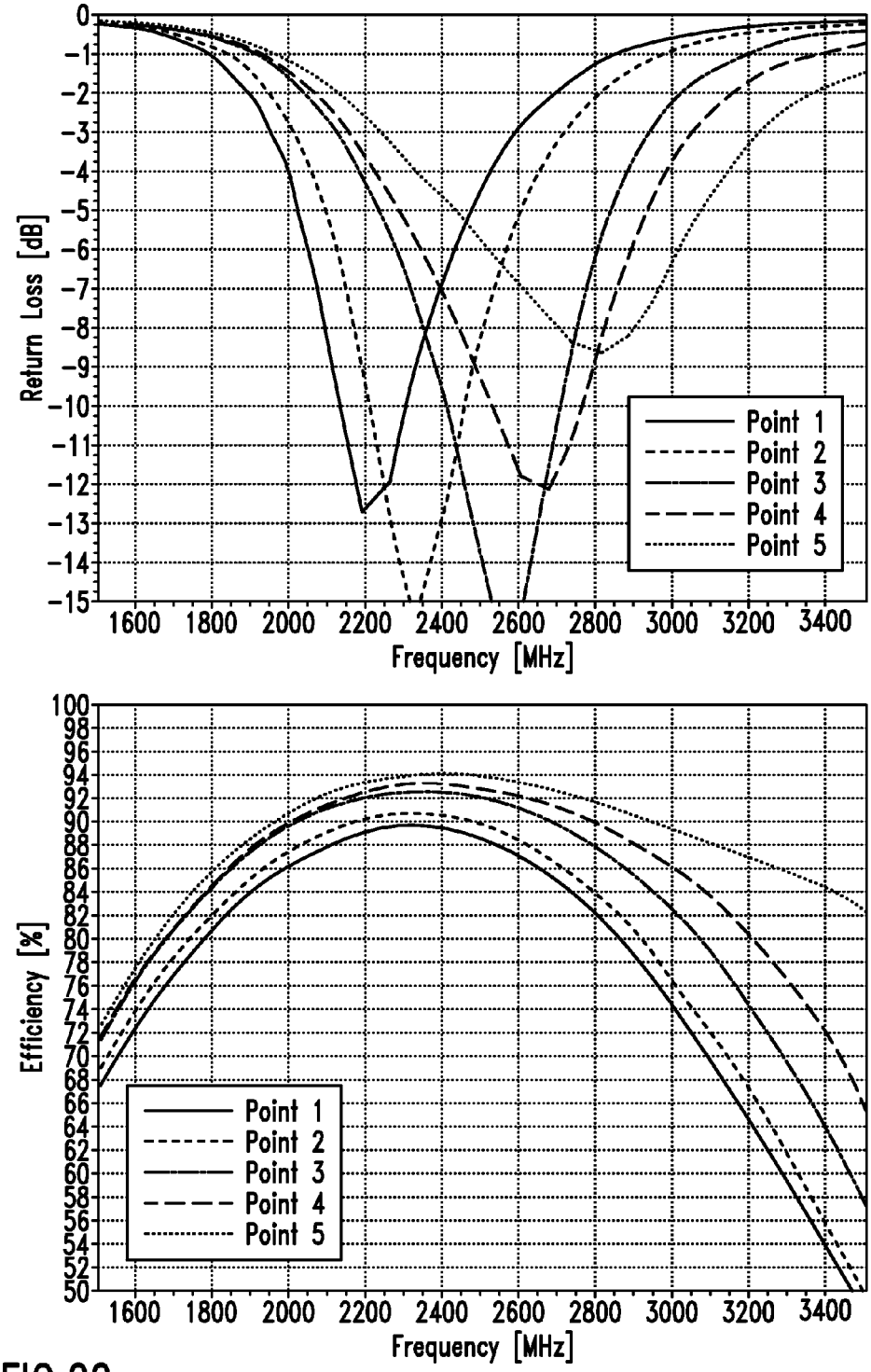
Figure 23:
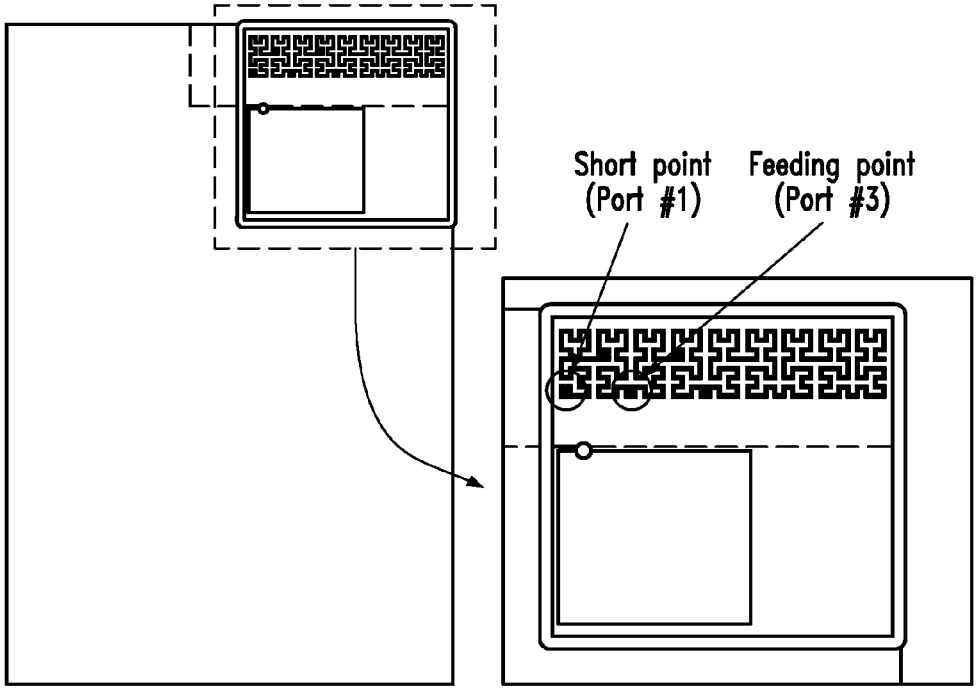
Figure 24:
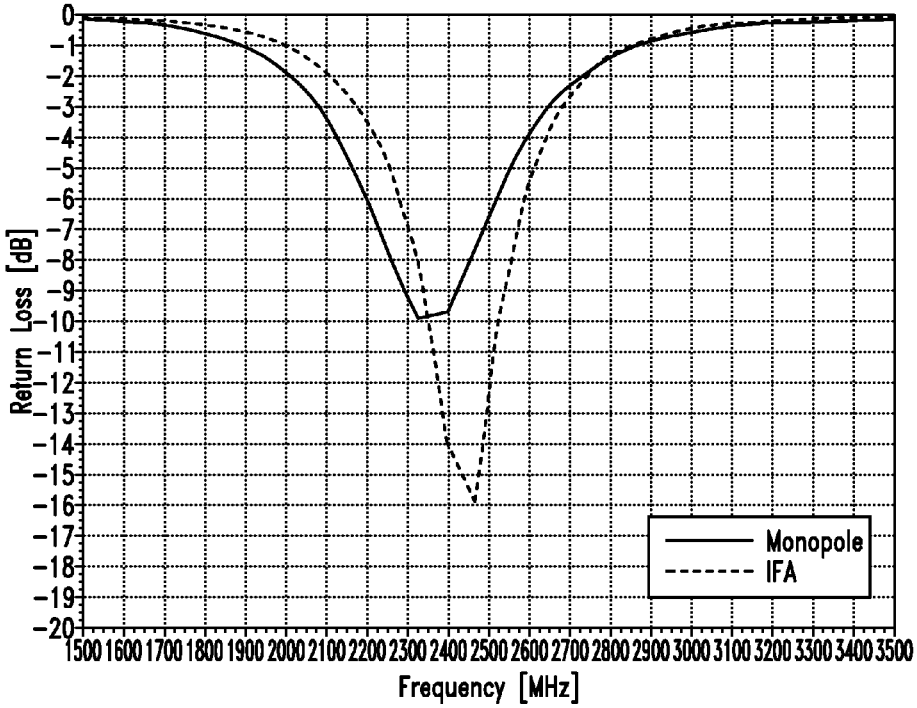
Figure 24:
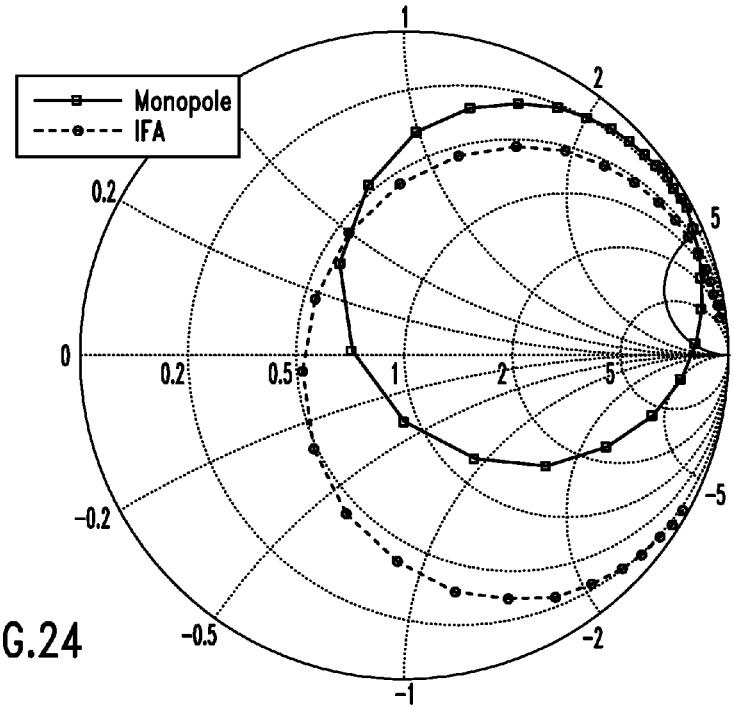
Figure 25:
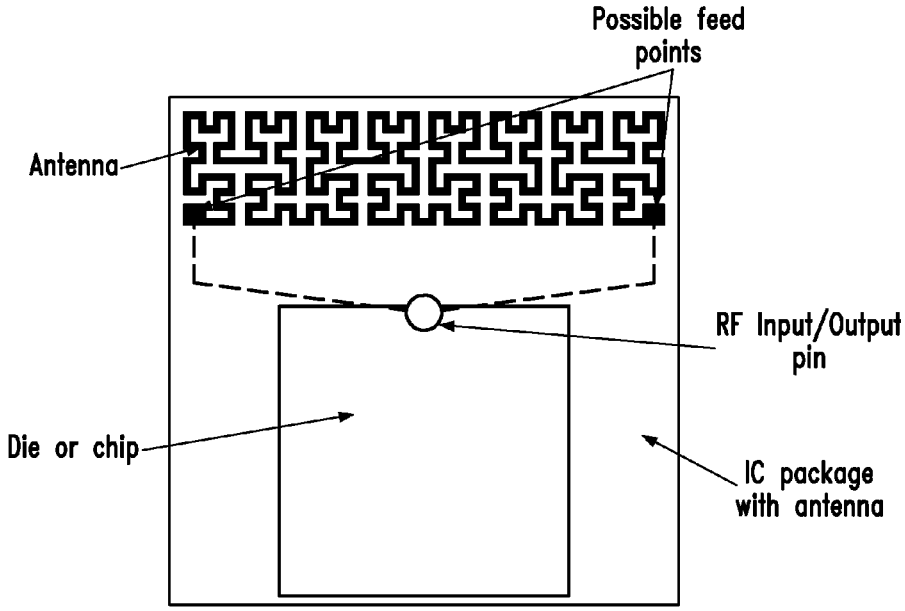
Figure 26:
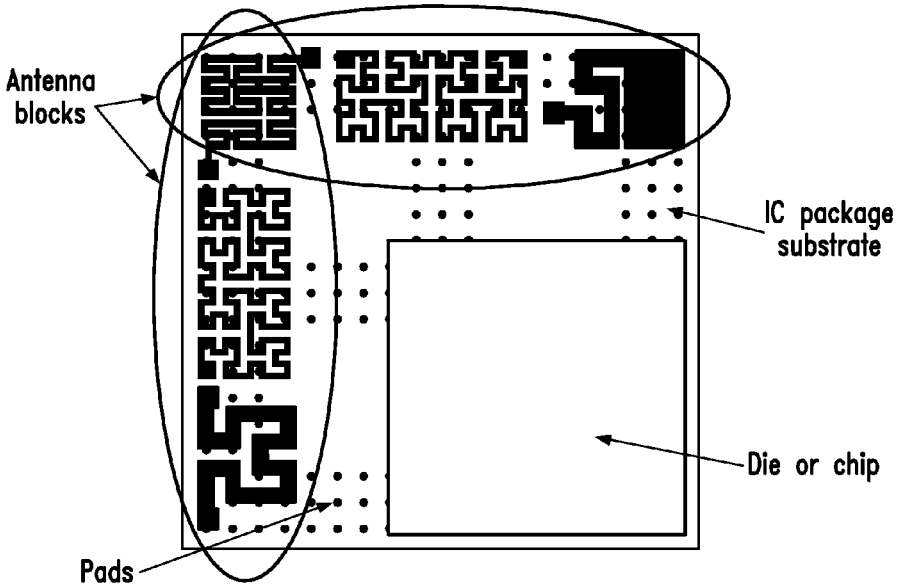
Figure 27:
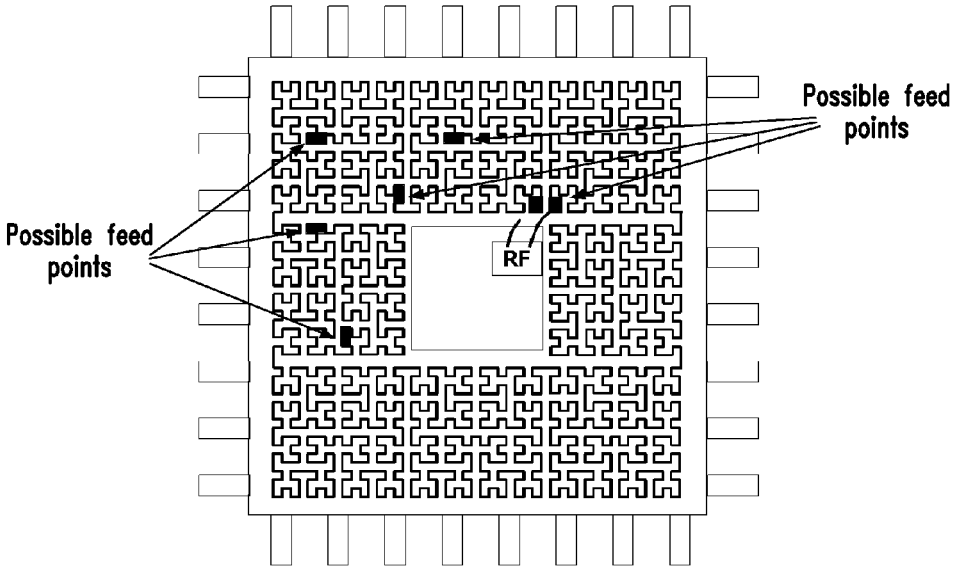
Figures 28A, 28B, 28C:
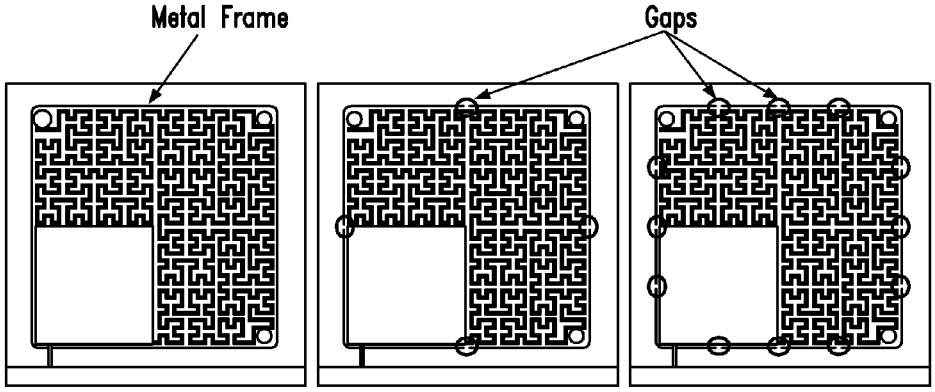
Figure 29:
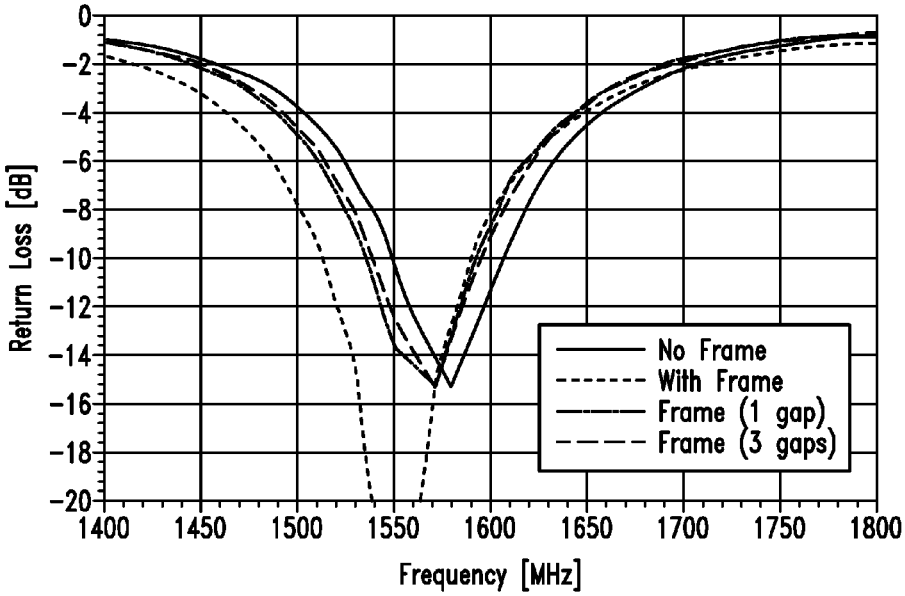
Figure 29:
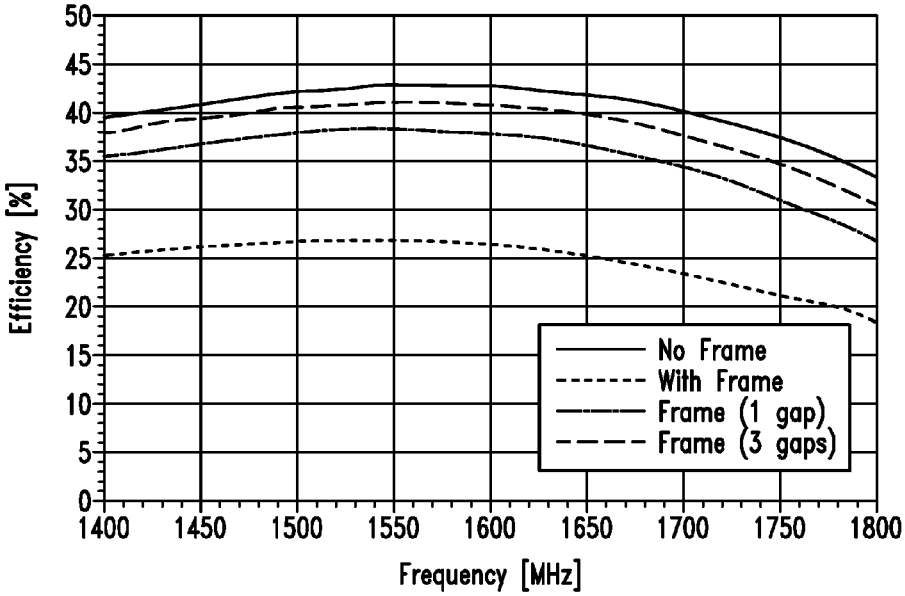
Figure 30:
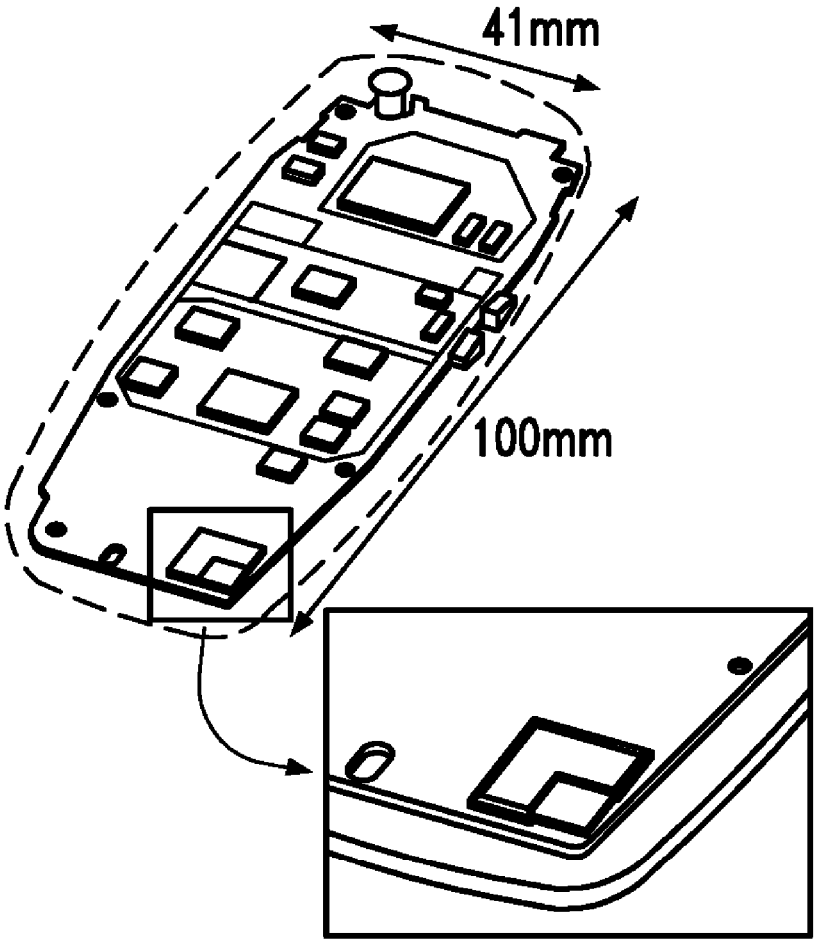
Figure 31:
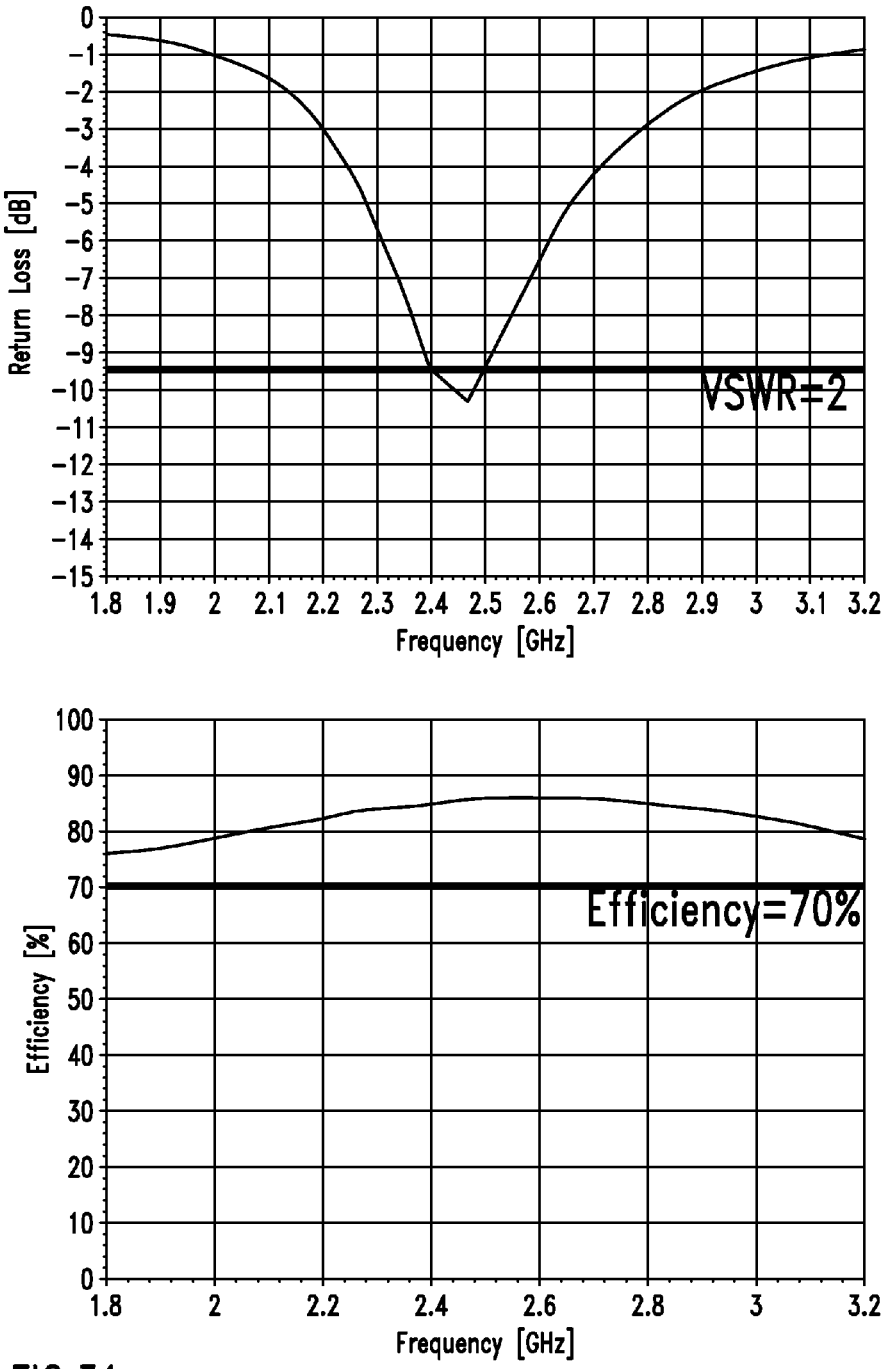
FIG. 31 shows an example return loss and efficiency of the FWSiP solution for Bluetooth™ when mounted on the PCB of a handset as in FIG. 30.
Figure 32:
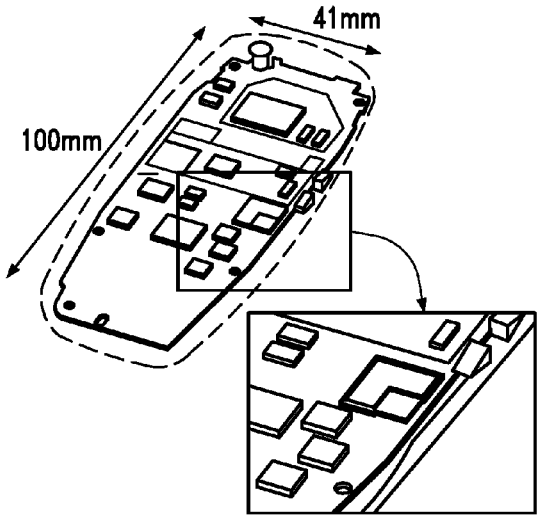
FIG. 32 shows another example placement of the Bluetooth™ FWSiP solution on the PCB of a handset. The position of the FWSiP module is chosen to achieve good antenna performance while minimizing the PCB space requirements.
Figure 33A:
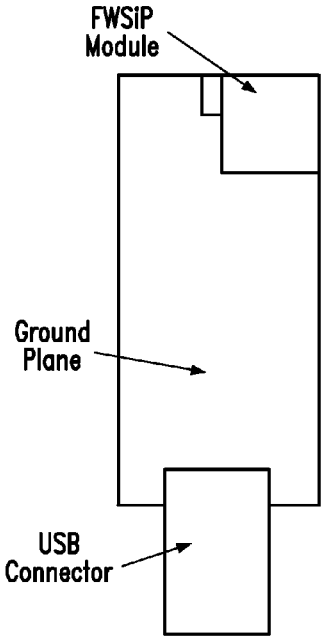
Figure 33B:
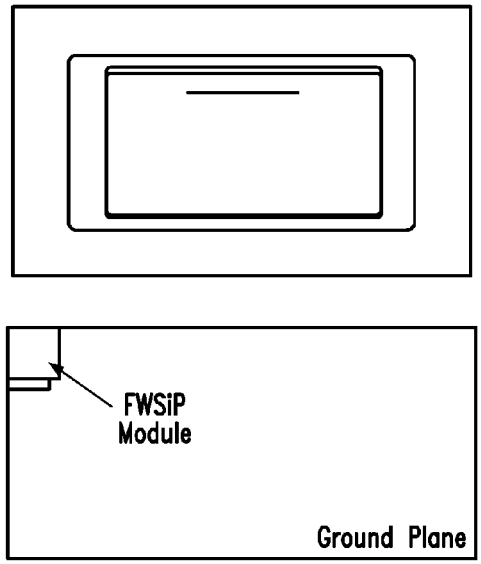

FIG. 33 illustrate example applications of an IC package including a miniature antenna as described herein. FIG. 33 *a* shows a USB dongle for Bluetooth™, and FIG. 33 *b* illustrates a wireless light switch using the ZigBee standard. In FIG. 33 *b* upper part the outer appearance of the light switch is shown, while in FIG. 33 *b*, lower part the ground plane with the FWSiP module is shown.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

The invention claimed is:

1. An antenna comprising:

a conducting trace, said conducting trace defining a curve extending continuously from a first end to a second end, said curve including at least three feeding points, the at least three feeding points being each located at a different point on said curve, wherein a first feeding point of the at least three feeding points is located at the first end of said curve, wherein a second feeding point of the at least three feeding points is located at a point between the first end and the second end of said curve, and wherein at least a portion of said curve features a complex geometry, said complex geometry being selected from a group of geometries consisting of a space-filling curve, a grid-dimension curve, a box-counting curve, a contour curve, and a curve having the shape of a multilevel structure.

2. The antenna according to claim 1, further comprising means for electrically contacting said conducting trace provided for at least one of the feeding points.

3. The antenna according to claim 1, wherein said conducting trace comprises a rigid piece.

4. The antenna according to claim 1, wherein said conducting trace comprises at least one material selected from the group of materials including metal, iron, steel, stainless steel, copper, aluminum, brass, silver, gold, alloy and conducting polymer.

5. The antenna according to claim 1, wherein said conducting trace is supported by a rigid backing.

6. The antenna according to claim 5, wherein said rigid backing comprises at least one dielectric material.

7. The antenna according to claim 1, wherein said antenna is provided in at least one conducting layer of a circuit board.

8. The antenna according to claim 1, wherein said antenna is prepared by a film process.

9. The antenna according to claim 1, wherein said conducting trace has at least one radiating arm.

10. The antenna according to claim 1, wherein the antenna comprises a second conducting trace defining a second curve extending continuously from a third end to a fourth end, and wherein said second conducting trace is electromagnetically-coupled to said conducting trace.

11. The antenna according to claim 1, wherein the antenna comprises a second conducting trace defining a second curve extending continuously from a third end to a fourth end and wherein said second curve includes at least one feeding point.

12. The antenna according to claim 1, wherein said conducting trace is coupled to another antenna structure.

13. The antenna according to claim 1, wherein at least part of said conducting trace is covered by an insulator.

14. The antenna according to claim 13, wherein said insulator is at least one selected from the group including:

ink, foil, paper, paint, plastic, a dielectric substrate, a PCB material, epoxy, FR4, deposited materials, LCP, glass fiber, ceramic, glass, and a semiconductor material.

15. The antenna according to claim 13, wherein said conducting trace is uncovered at said feeding points.

16. The antenna according to claim 1, wherein said conducting trace is provided on a circuit board together with an integrated circuit.

17. The antenna according to claim 16, wherein said integrated circuit is operably connected to said conducting trace.

18. The antenna according to claim 16, wherein said conducting trace is not covered by said integrated circuit.

19. The antenna according to claim 16, wherein said conducting trace is partially covered by said integrated circuit.

20. The antenna according to claim 19, wherein at least one of said feeding points of the conducting trace is covered by said integrated circuit.

21. The antenna according to claim 16, wherein said conducting trace is on at least one side next to said integrated circuit.

22. The antenna according to claim 1, wherein said antenna is at least one antenna selected from a group of antennae including: a monopole, a dipole, a patch antenna, a slot antenna, a microstrip antenna, a coplanar antenna, a wound antenna, an aperture antenna, a loop antenna, an inverted F-antenna and an antenna array.

23. The antenna according to claim 1, wherein said feeding points are covered by a removable cover.

24. The antenna according to claim 1, wherein said conducting trace is contacted at least two feeding points by removable connections.

25. The antenna according to claim 1, wherein a diameter of the smallest sphere completely enclosing said conducting trace is less than ⅕ of the free space wavelength of a resonant frequency of the antenna.

26. An apparatus, comprising:

at least one antenna, and a wireless device coupled to the at least one antenna, wherein the at least one antenna comprises:

a conducting trace, said conducting trace defining a curve extending continuously from a first end to a second end, said curve including at least three feeding points, the at least three feeding points being each located at a different point on said curve, wherein a first feeding point of the at least three feeding points is located at the first end of said curve, wherein a second feeding point of the at least three feeding points is located at a point between the first end and the second end of said curve, and wherein at least a portion of said curve features a complex geometry, said complex geometry being selected from a group of geometries consisting of a space-filling curve, a grid-dimension curve, a box-counting curve, a contour curve, and a curve having the shape of a multilevel structure.

27. The apparatus according to claim 26, wherein said at least one antenna is mounted on a circuit board of said wireless device.

28. The apparatus according to claim 26, wherein said at least one antenna is provided on a conducting layer of a circuit board of said wireless device.

29. The apparatus according to claim 26, wherein said at least one antenna is embedded in an integrated circuit package that includes other parts of said wireless device.

30. The apparatus according to claim 26, wherein at least one of the feeding points of said antenna is electrically connected to another electric circuit of said wireless device.

31. The apparatus according to claim 26, wherein at least one connection between said antenna and other parts of said wireless device is removable.

32. The apparatus according to claim 26, further comprising at least one electrical switch coupling at least one feeding point of the antenna to an electrical circuit of said wireless device.

33. The apparatus according to claim 26, wherein energy is provided to the antenna at least two feeding points thereof at the same time.

34. The apparatus according to claim 26, wherein at least one feeding point is connected to ground of said wireless device.

35. The apparatus according to claim 26, wherein the at least one antenna comprises a second conducting trace defining a second curve extending continuously from a third end to a fourth end, and wherein said conducting trace and the second conducting trace are connected to each other by an integrated circuit provided on a common circuit substrate as said antenna.

36. The apparatus according to claim 26, wherein a space is provided between said antenna and the member of said wireless device to which said antenna is mounted.

37. The apparatus according to claim 26, wherein said feeding points which are not electrically connected to the wireless device provide support to said antenna.

38. The apparatus according to claim 26, wherein said conducting trace is provided such that at least a part of said conducting trace is not overlaid by a ground plane of said wireless device.

39. The apparatus according to claim 26, wherein said wireless device is at least one selected from the group including: a cellular phone, a handheld phone, a satellite phone, a multimedia terminal, a personal digital assistant (PDA), a portable music player, a radio, a digital camera, a USB dongle, a wireless headset, an ear phone, a hands-free kit, an electronic game, a remote control, an electric switch, a light switch, an alarm, a car kit, a computer card, a PCMCIA card, a sensor, a handset, a dongle, a computer interface, a computer mouse, a keyboard, a personal computer, an MP3 player, a portable DVD/CD player, a smoke detector, a switch, a motion sensor, a pressure sensor, a temperature sensor, a medical sensor, a meter, an alarm, a short/medium range wireless connectivity application, a Mini-PCI, a Notebook PC with WiFi module integrated, compact flash wireless cards, UART dongles, pocket PC with integrated WiFi, access points for hot-spots.

40. The apparatus according to claim 26, wherein said wireless device is configured to operate in at least one wireless communication system selected from the group including: Bluetooth, 2.4 GHz Bluetooth, 2.4 GHz IEEE802.11b/g, 5 GHz IEEE802.11a, Hyperlan, IEEE802.11 (WiFi), ultra wide band (UWB), Wimax, ZigBee, ZigBee at 860 MHz, ZigBee at 915 MHz, GPS, GPS at 1.575 GHz, GPS at 1.227 GHz, Galileo, GSM-900, DCS-1800, UMTS, CDMA, DBA, WLAN, WLAN at 2.4 GHz-5 GHz, PCS1900, KPCS, WCDMA, DAB, 2.4-2.483 GHz band, and 2.471-2.497 GHz band.

41. The apparatus, comprising:

a surface mount device (SMD) component including at least three access ports, a conducting trace defining a curve extending continuously from a first end to a second end, said conducting trace being connected to said access ports at least three points thereof, said at least three points being each located at a different point on said curve, wherein a first access port of the at least three access ports is connected to a first point of the at least three points located at the first end of said curve, wherein a second access port of the at least three access ports is connected to a second point of the at least three points located at a point between the first end and the second end of said curve, wherein at least a portion of said curve features a complex geometry, said complex geometry being selected from a group of geometries consisting of a space-filling geometry, a grid-dimension geometry, a box-counting geometry, a contour curve geometry, and the shape of a multilevel structure, and wherein said conducting trace defining defines an antenna element within said SMD component.

42. The apparatus according to claim 41, wherein at least one of the at least three access ports comprises means for electrically contacting the SMD component.

43. The apparatus according to claim 41, wherein said conducting trace comprises a rigid piece.

44. The apparatus according to claim 41, wherein said conducting trace is supported by a rigid backing.

45. The apparatus according to claim 44, wherein said rigid backing comprises at least one dielectric material.

46. The apparatus according to claim 41, wherein said antenna element is provided in at least one conducting layer of a circuit board.

47. The apparatus according to claim 41, wherein said antenna element is prepared by a film process.

48. The apparatus according to claim 41, wherein said conducting trace has at least one radiating arm.

49. The apparatus according to claim 41, wherein the apparatus comprises a second conducting trace defining a second curve extending continuously from a third end to a fourth ends, and wherein said second conducting trace is electromagnetically coupled to said conducting trace.

50. The apparatus according to claim 41, wherein the SMD component includes at least one additional access port, wherein the apparatus comprises a second conducting trace defining a second curve extending continuously from a third end to a fourth end, and wherein said second conducting trace is connected to the at least one additional access port at at least one point thereof.

51. The apparatus according to claim 41, wherein said conducting trace is coupled to another antenna structure.

52. The apparatus according to claim 41, wherein at least part of said conducting trace is covered by an insulator.

53. The apparatus according to claim 41, wherein said access ports are covered by a removable cover.

54. The apparatus according to claim 41, wherein said conducting trace is contacted at least two access ports by removable connections.

55. The apparatus according to claim 41, wherein a diameter of the smallest sphere completely enclosing said conducting trace is less than ⅕ of the free space wavelength of a resonant frequency of the antenna.

56. The apparatus of claim 41, further comprising a wireless device containing the at least one SMD component.

57. The apparatus according to claim 56, wherein said at least one SMD component is embedded in an integrated circuit package that includes other parts of said wireless device.

58. The apparatus according to claim 56, wherein the SMD component further comprises at least one access port electrically connected to other electric circuits of said wireless device.

59. The apparatus according to claim 56, further comprising at least one removable connection between said SMD component and other parts of said wireless device.

60. The apparatus according to claim 56, further comprising at least one electrical switch connecting at least one access port to electrical circuits of said wireless device.

61. The apparatus according to claim 56, wherein energy is provided to the antenna element within said SMD component at least two access ports at the same time.

62. The apparatus according to claim 56, wherein at least one access port is electrically connected to ground of said wireless device.

63. The apparatus according to claim 56, wherein the apparatus comprises a second conducting trace defining a second curve extending continuously from a third end to a fourth end, and wherein said conducting trace and the second conducting trace are connected to each other by an integrated circuit which is provided on the same circuit substrate as said SMD component.

64. The apparatus according to claim 56, wherein a space is provided between said SMD component and the member of said wireless device to which said SMD component is mounted.

65. The apparatus according to claim 56, wherein said access ports which are not electrically connected provide support to said SMD component.

66. The apparatus according to claim 56, wherein said conducting trace is provided such that at least a part of said conducting trace is not overlaid by a ground plane of said wireless device.

67. The apparatus according to claim 41, wherein said conducting trace is provided on a circuit board together with an integrated circuit.

68. The apparatus according to claim 67, wherein said integrated circuit is operably connected to said conducting trace.

69. The apparatus according to claim 67, wherein said conducting trace is not covered by said integrated circuit.

70. The apparatus according to claim 67, wherein said conducting trace is partially covered by said integrated circuit.

71. The apparatus according to claim 70, wherein at least one of said access ports is covered by said integrated circuit.

72. The apparatus according to claim 67, wherein said integrated circuit is provided in relation to said conducting trace in a way that said conducting trace is on at least one side next to said integrated circuit.

73. An apparatus, comprising:

an integrated circuit housed in an IC package, and an antenna comprising a conducting trace also housed in the IC package, said conducting trace defining a curve extending continuously from a first end to a second end, at least a portion of said curve being shaped according to a complex geometry, said complex geometry selected from a group of geometries consisting of a space-filling curve, a grid-dimension curve, a box-counting curve, a contour curve, and a curve having the shape of a multi-level structure, said conducting trace including at least three points along said curve at which it can be accessed for feeding purposes, the at least three points being each located at a different point on said curve, a first point of the at least three points being located at the first end of said curve, a second point of the at least three points being located at a point between the first end and the second end of said curve.

74. The apparatus according to claim 73, wherein at least one of said points is accessible from the outside of said IC package through an electrical contact.

75. The apparatus according to claim 73, wherein at least one of said points is connected to the integrated circuit of said IC package, and wherein said connected points are not directly accessible from the outside of said IC package.

76. The apparatus according to claim 73, wherein, said conducting trace is supported by a rigid backing.

77. The apparatus according to claim 76, wherein said rigid backing comprises at least one dielectric material.

78. The apparatus according to claim 73, wherein said conducting trace is provided in at least one layer of a circuit board.

79. The apparatus according to claim 73, wherein said conducting trace is not covered by the integrated circuit of said IC package.

80. The apparatus according to claim 73, wherein said conducting trace is connected to ground of said IC package at least one feeding purposes point.

81. The apparatus according to claim 73, wherein at least a part of said conducting trace is covered by the integrated circuit of said IC package.

82. The apparatus according to claim 81, wherein at least one of said feeding purposes points is covered by said integrated circuit.

83. The apparatus according to claim 73, wherein said conducting trace is placed on at least one side next to the integrated circuit of said IC package.

84. The apparatus according to claim 73, wherein said conducting trace has at least one radiating arm.

85. The apparatus according to claim 73, wherein the antenna comprises a second conducting trace also housed in the IC package, wherein said second conducting trace defines a second curve extending continuously from a third end to a fourth end, and wherein said second conducting trace is electromagnetically coupled to said conducting trace.

86. The apparatus according to claim 73, wherein the antenna comprises a second conducting trace also housed in the IC package, wherein said second conducting trace defines a second curve extending continuously from a third end to a fourth end, wherein said second conducting trace includes at least one point along said second curve at which it can be accessed for feeding purposes.

87. The apparatus according to claim 73, wherein said conducting trace is coupled to another antenna structure.

88. The apparatus according to claim 73, wherein at least part of said conducting trace is covered by an insulator.

89. The apparatus according to claim 73, wherein the integrated circuit of said IC package is provided at a corner of said IC package.

90. The apparatus according to claim 73, wherein the integrated circuit of said IC package is provided on a side of said IC package between two adjacent corners of said IC package.

91. The apparatus according to claim 73, further comprising a metal frame provided within said IC package, the metal frame comprising at least one discontinuity on at least one side of said IC package.

92. The apparatus according to claim 73, wherein a diameter of the smallest sphere completely enclosing said conducting trace is less than ⅕ of the free space wavelength of a resonant frequency of the antenna.

93. The apparatus according to claim 73, wherein the integrated circuit of said IC package is operably connected to said conducting trace.

94. The apparatus of claim 73, further comprising a wireless device containing the IC-package.

95. The apparatus according to claim 94, wherein said at least one IC-package is mounted on a circuit board.

96. The apparatus according to claim 94, wherein at least one feeding purposes point of said IC-package is electrically connected to other electric circuits of said wireless device.

97. The apparatus according to claim 94, wherein at least one connection between said IC-package and other parts of said wireless device is removable.

98. The apparatus according to claim 94, further comprising at least one electrical switch connecting at least one feeding purposes point can be electrically connected to electrical circuits of said wireless device.

99. The apparatus according to claim 94, wherein energy is provided to the antenna within said IC package at least two feeding purposes points at the same time.

100. The apparatus according to claim 94, wherein at least one feeding purposes point is electrically connected to ground of said wireless device.

101. The apparatus according to claim 94, wherein the antenna comprises a second conducting trace also housed in the IC package, wherein said second conducting trace defines a second curve extending continuously from a third end to a fourth end, and wherein said conducting trace and the second conducting trace are connected to each other by the integrated circuit of said IC-package.

102. The apparatus according to claim 94, wherein a space is provided between said IC-package and the member of said wireless device to which said IC-package is mounted.

103. The apparatus according to claim 94, wherein said feeding purposes points which are not electrically connected provide support to said IC-package.

104. The apparatus according to claim 94, wherein said conducting trace is provided such that at least a part of said conducting trace is not overlaid by a ground plane of said wireless device.

* * * * *